US011020644B2

(12) United States Patent
Hawkins

(10) Patent No.: US 11,020,644 B2
(45) Date of Patent: Jun. 1, 2021

(54) SWING MECHANICS SHOULDER HARNESS SYSTEM AND ASSOCIATED SYSTEMS AND METHODS

(71) Applicant: Craig Steven Hawkins, Kennesaw, GA (US)

(72) Inventor: Craig Steven Hawkins, Kennesaw, GA (US)

( * ) Notice: Subject to any disclaimer, the term of this patent is extended or adjusted under 35 U.S.C. 154(b) by 0 days.

(21) Appl. No.: 16/860,409

(22) Filed: Apr. 28, 2020

(65) Prior Publication Data

US 2020/0368598 A1 Nov. 26, 2020

Related U.S. Application Data

(63) Continuation-in-part of application No. 16/567,425, filed on Sep. 11, 2019, now Pat. No. 10,806,983.

(60) Provisional application No. 62/849,982, filed on May 20, 2019, provisional application No. 62/886,959, filed on Aug. 14, 2019.

(51) Int. Cl.

| | |
|---|---|
| ***A63B 69/00*** | (2006.01) |
| *A63B 102/32* | (2015.01) |
| *A63B 69/38* | (2006.01) |
| *A63B 102/20* | (2015.01) |

(52) U.S. Cl.

CPC ..... *A63B 69/0059* (2013.01); *A63B 69/0002* (2013.01); *A63B 69/38* (2013.01); *A63B 2069/0008* (2013.01); *A63B 2102/20* (2015.10); *A63B 2102/32* (2015.10); *A63B 2209/08* (2013.01); *A63B 2209/10* (2013.01); *A63B 2225/74* (2020.08)

(58) Field of Classification Search

CPC ..... A63B 69/0002; A63B 2069/0008; A63B 69/0059; A63B 69/38; A63B 2102/20; A63B 2102/32; A63B 2209/08; A63B 2225/74; A63B 2209/10

USPC ..... 473/422, 450, 458

See application file for complete search history.

(56) References Cited

U.S. PATENT DOCUMENTS

| | | | | |
|---|---|---|---|---|
| 3,101,196 A * | 8/1963 | Ferrara | A63D 5/00 | 473/63 |
| 3,419,277 A * | 12/1968 | Martin | A63B 69/0059 | 473/214 |
| 3,595,583 A * | 7/1971 | Oppenheimer | A63B 69/0059 | 473/215 |
| 3,937,465 A * | 2/1976 | Roland | A63B 69/38 | 473/461 |
| 4,030,732 A * | 6/1977 | Vincent | A63B 21/0004 | 473/464 |

(Continued)

*Primary Examiner* — Mitra Aryanpour

(74) *Attorney, Agent, or Firm* — John L. Doughty; Doughty Law, L.L.C.

(57) ABSTRACT

Various embodiments for a swing training system are described that include a shoulder harness system having a wrist attachment and at least one coupling member having a first end configured to couple to the wrist attachment and a second end configured to couple to one of a shoulder portion of a chest portion of the shoulder harness system, where the shoulder harness system is configured to maintain a chest-to-arm position of an operator and detach from one of the shoulder portion or the chest portion of the shoulder harness system in response to a predefined amount of force being exerted by the operator during a swing motion using a swinging device; and at least one of: a light system and a stride training system.

12 Claims, 24 Drawing Sheets

(56) References Cited

U.S. PATENT DOCUMENTS

| | | | | | |
|---|---|---|---|---|---|
| 4,746,118 | A * | 5/1988 | Deveney | A63B 69/0002 | 473/208 |
| 4,984,789 | A * | 1/1991 | Socci | A63B 69/0002 | 473/458 |
| 5,154,416 | A * | 10/1992 | Smull | A63B 69/0059 | 473/458 |
| 7,128,658 | B2 * | 10/2006 | DuFour | A63B 69/0059 | 473/276 |
| 7,214,139 | B2 * | 5/2007 | Parris | A63B 69/3608 | 473/207 |
| 8,852,015 | B1 * | 10/2014 | Hoang | A63B 69/3608 | 473/214 |
| 9,295,868 | B2 * | 3/2016 | Beroza | A63B 21/0555 | 473/458 |
| 9,592,435 | B1 * | 3/2017 | Faucette | A63B 69/3608 | 473/207 |
| 9,700,775 | B2 * | 7/2017 | Hamilton | A63B 69/0002 | 473/458 |
| 10,456,646 | B2 * | 10/2019 | English | A63B 69/0059 | 473/458 |
| 10,806,983 | B1 * | 10/2020 | Hawkins | A63B 69/0059 | 473/458 |
| 2002/0039930 | A1 * | 4/2002 | Smith | A63B 69/0059 | 473/215 |
| 2009/0098945 | A1 * | 4/2009 | George | A63B 21/0552 | 473/213 |
| 2013/0324331 | A1 * | 12/2013 | Barnhill | A63B 69/0002 | 473/458 |
| 2015/0165293 | A1 * | 6/2015 | Hamilton | A63B 69/0059 | 473/453 |
| 2021/0001197 | A1 * | 1/2021 | Wesig | A63B 69/0071 | 473/450 |
| 2021/0008426 | A1 * | 1/2021 | Hawkins | A63B 69/0002 | 473/458 |

* cited by examiner

SWING MECHANICS SHOULDER HARNESS SYSTEM AND ASSOCIATED SYSTEMS AND METHODS

CROSS-REFERENCE TO RELATED APPLICATIONS

This application is a continuation-in-part of U.S. patent application Ser. No. 16/567,425 entitled "SWING MECHANICS SHOULDER HARNESS AND BARREL AX," filed Sep. 11, 2019, which claims the benefit of and priority to U.S. Provisional Patent Application No. 62/849,982 entitled "MAGNETIC SHOULDER HARNESS WITH BARREL AX," filed May 20, 2019, and further claims the benefit of and priority to U.S. Provisional Patent Application No. 62/886,959 entitled "VELCRO HITTER FOR BASEBALL AND SOFTBALL," filed Aug. 14, 2019, the contents of which being incorporated by reference in their entireties herein.

BACKGROUND

Swing training aids are beneficial in training an operator the proper biomechanics of swinging a swinging device such as a baseball bat, a golf club, or other sports apparatus. Notably, a swing, such as a baseball swing, can be separated into six distinct stages, such as the stance; stride; coiling; swing initiation; swing acceleration; and follow-through. Swing training aids help teach an operator the correct biomechanical movements for swinging the swinging device through a particular stage of the swing or, alternatively, through multiple stages of the swing. Correspondingly, training an operator on how to master the most efficient and effective biomechanical sequence of movements when swinging a swinging device may be difficult without repeatable reinforcement of an ideal biomechanical movement.

BRIEF SUMMARY OF INVENTION

A swing training system is described. The swing training system includes a shoulder harness system comprising a wrist attachment and at least one coupling member having a first end configured to couple to the wrist attachment and a second end configured to couple to one of a shoulder portion of a chest portion of the shoulder harness system, where the shoulder harness system is configured to maintain a chest-to-arm position of an operator and detach from one of the shoulder portion or the chest portion of the shoulder harness system in response to a predefined amount of force being exerted by the operator during a swing motion using a swinging device.

The swing training system further comprises at least one of a light system comprising a first light emitting device configured to couple to the wrist attachment and a second light emitting device configured to couple to a bottom end of the swinging device; and a stride training system comprising a foot harness configured to secure a foot magnet to a bottom of a foot of the operator and a target magnet plate, wherein the foot magnet and the target magnet plate are configured to form a magnetic coupling and emit an audible noise when the foot magnet comes into physical contact with the target magnet plate.

The swing training system may further include a ball configured to connected to a vest or a shirt of the operator to rest the swinging device next to a desired position on a body of the operator and maintain a degree of separation between the operator and the swinging device.

The first light emitting device may be coupled to the wrist attachment, the first light emitting device being sized and positioned to shine light across a chest of the operator during the swing motion. The second light emitting device may be coupled to a bottom end of the swinging device, the second light emitting device being sized and positioned to shine light at a ground surface during the swing motion. The first light emitting device may be configured to emit light of a first color and the second light emitting device may be configured to emit light of a second color, the second color being a different color than the first color. The first light emitting device may include a first light emitting element, a first switch, and a first battery, and the second light emitting device may include a second light emitting element, a second switch, and a second battery. The batteries may include replaceable or rechargeable batteries. In some embodiments, the batteries (e.g., the first battery and the second battery) are chargeable using a universal serial bus (USB) port connection, an electrical outlet connection, or other suitable connection.

The at least one coupling member comprises a double-sided strip hook-and-loop fastening strip or a rigid member formed of metal. The wrist attachment may be a first wrist attachment to be worn on a first wrist of the operator, where the swing training system further comprises a second wrist attachment to be worn on the second wrist of the operator. Further, the at least one coupling member is a first coupling member and a second coupling member, a first end of the first coupling member is configured to be secured to the first wrist attachment, and a second end of the first coupling member is configured to removably attach to the shoulder portion, and a first end of the second coupling member is configured to be secured to the second wrist attachment, and a second end of the second coupling member is configured to removably attach to the chest portion. The second end of the first coupling member comprises a first magnet configured to magnetically couple to the shoulder portion, and the second end of the second coupling member comprises a second magnet configured to magnetically couple to the chest portion.

The swing training system may further include a collar configured to detechably attach to a shaft of a swinging device, the collar comprising a first portion detachably attached to a second portion, the collar further comprising an elongated substantially horizontal surface projecting from at least one of the first portion and the second portion, the elongated substantially horizontal surface being adapted to contact a ball.

A method is provided that includes providing the swing training system as described above, positioning the shoulder harness system on the operator; and performing, by the operator, a swing using the shoulder harness system and at least one of the light system or the stride training system.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
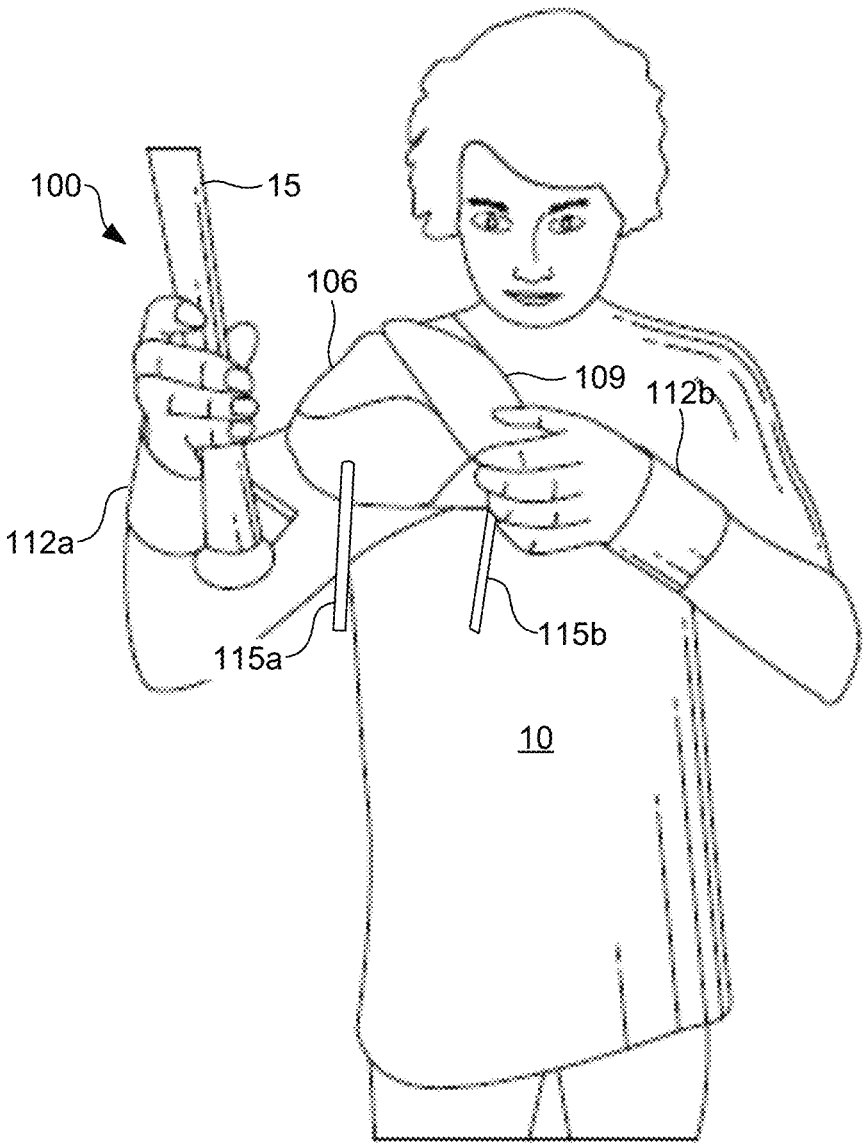
FIG. 1 is a perspective view of a shoulder harness system acting as a swing training aid and worn on an operator according to various embodiments of the present disclosure.

The present disclosure relates to a swing mechanics shoulder harness, barrel ax, light system, stride training system, and ball system that can be used in various combinations to train an operator, such as an athlete, the proper biomechanics of a swing. As noted above, obtaining efficient swing mechanics is difficult to develop in both young and advanced athletes alike. To that end, swing training aids are beneficial tools to help teach the proper biomechanics of a swing. Swing training aids promote muscle-memory and reinforce the correct swing sequencing and timing to promote the efficient delivery of the maximum amount of force to a ball or other object.

Various embodiments are described herein for a shoulder harness that can be used to train proper biomechanics of a swing. The shoulder harness and/or barrel ax provides an alternative to currently available swing training aids, for instance, as the shoulder harness is easier to couple wrist portions to the harness while simultaneously holding a swinging device, as opposed to currently available products that requires an operator to loop connectors to various attachment components that are located on either the swinging device or other parts of the operator. Also, the currently available products may prematurely interrupt the swing sequence because it is easy for the connectors to slip off and become detached from the various attachment components, thereby, interrupting the operator and requiring the operator to reset their swing by resetting the swing training aid. Moreover, currently available products also physically prevent the operator from completing all six stages of a swing due to the harness or the connectors physically impeding completion of the swing.

In the context outlined above, the embodiments described herein are directed to a shoulder harness and/or a barrel ax for training an operator a preferred biomechanical swing movement to efficiently deliver the maximum amount of force to an object, such as a baseball, a golf ball, cricket swing, tennis swing, etc. The shoulder harness and/or the barrel ax provide an alternative swing training aid because, in some embodiments, the shoulder harness utilizes magnetic couplers or hook-and-loop fasteners that couple to a harness worn by an operator. When a predetermined force is exerted at a predetermined stage of a swing, the couplers are configured to decouple from at least a portion of the harness, or decoupling entirely, allowing the operator to accelerate from the stance through the other stages of the swing sequence. All six stages of the swing can be accomplished.

Furthermore, the barrel ax portion is configured to provide visual feedback to the operator of when the operator is making square contact with an object relative to the swinging device. In various embodiments of the present disclosure, the strength of the coupling force may be adjusted by a plurality of coupling means, which may include a magnet in some embodiments, adding layers of padding to the padded member that covers the coupling section, or by adjusting the length of the coupling member on the wrist attachment. In various embodiments of the present disclosure, the coupling means of the wrist attachment is a hook and loop strap that may connect to either the shoulder portion or the chest portion of the shoulder harness.

Accordingly, a swing training system is provided that includes a shoulder harness. The shoulder harness may include a shoulder portion configured to be worn about a shoulder of an operator, a chest portion configured to be worn about a chest of the operator, at least one wrist attachment configured to be worn on a wrist of the operator, and at least one coupling member. The at least one coupling member may include a first end and a second end. The first end of the at least one coupling member can be configured to be secured to the at least one wrist attachment and the second end of the at least one coupling member configured to detachably attach to one of: the shoulder portion or the chest portion. The at least one coupling member is configured to maintain a chest-to-arm position of the operator and detach from one of the shoulder portion or the chest portion in response to a predefined amount of force being exerted by the operator during a swing motion.

In some embodiments, the at least one wrist attachment includes a first wrist attachment to be worn on a first wrist of the operator and a second wrist attachment to be worn on the second wrist of the operator, where the at least one coupling member is a first coupling member and a second coupling member, a first end of the first coupling member is configured to be secured to the first wrist attachment, and a second end of the first coupling member is configured to removably attach to the shoulder portion, a first end of the second coupling member is configured to be secured to the second wrist attachment, and a second end of the second coupling member is configured to removably attach to the chest portion.

In some embodiments, the second end of the first coupling member can include a first magnet configured to magnetically couple to the shoulder portion; and the second end of the second coupling member comprises a second magnet configured to magnetically couple to the chest portion. Alternatively, in some embodiments, the second end of the first coupling member comprises a first plurality of hook-and-loop fasteners (e.g., VELCRO) that are configured to couple to the shoulder portion; and the second end of the second coupling member comprises a second plurality of hook-and-loop fasteners (e.g., VELCRO) configured to couple to the chest portion.

Further, in some embodiments, the coupling member includes a noise emitting device configured to emit a noise when the at least one coupling member decouples from the shoulder portion or the chest portion. Also, the shoulder portion can include a first padded member configured to be positioned on the shoulder of the operator; and the chest portion can include a second padded member configured to be worn on the chest of the operator. The at least one coupling member can be at least one cylindrical rod in some embodiments.

In some embodiments, the swing training system further includes a collar configured to detachably attach to a shaft of a swinging device, the collar comprising a first portion detachably attached to a second portion, the collar further comprising an elongated substantially horizontal surface projecting from at least one of the first portion and the second portion, the elongated substantially horizontal surface being adapted to contact a ball. For instance, the cylindrical collar can be configured to secure to a shaft of a baseball bat or a golf club.

Turning now to the drawings, FIG. 1 illustrates an example of an operator 10 wearing a shoulder harness system 100 according to various embodiments. The operator 10 is shown holding a swinging device 15, which can include a baseball bat, a golf club, a cricket bat, or other swinging device as can be appreciated. While many embodiments are described herein with reference to baseball, the invention is not so limited unless limited by the appended claims. The relative sizes of various components of the shoulder harness system 100, as shown in the figures, are not intended to be limiting, as the individual components of the shoulder harness system 100 can vary in size and/or proportions as compared to each other in various embodiments, as will be appreciated.

In various embodiments, the shoulder harness system 100 includes a shoulder portion 106, a chest portion 109, one or more wrist attachments 112*a*, 112*b* (collectively "wrist attachments 112"), and one or more coupling members 115*a*, 115*b* (collectively "coupling members 115"). The shoulder portion 106 is configured to be worn about a shoulder of the operator 10. Similarly, the chest portion 109 is configured to be worn about a chest of the operator. The wrist attachments 112 are configured to be worn on wrists of the operator 10. For instance, in embodiments in which only a single wrist attachment 112 is employed, the wrist attachment may be secured to one of the left wrist or the right wrist of the operator 10. Alternatively, in embodiments in which two wrist attachments 112 are employed, a first wrist attachment 112*a* may be secured to the left wrist of the operator 10 and the second wrist attachment 112*b* may be secured to the right wrist of the operator 10, or vice versa. In some embodiments, the shoulder portion 106 and the chest portion 106 make up a shirt, a vest, or other wearable.

For instance, in embodiments in which the shoulder portion 106 and the chest portion 106 make up a vest, on the vest, a plurality of slots can be provided that are cut into various parts of vest or shirt being used for the coupling members 115 to attach to (e.g., a detachably attachment). For example, in the slots, a first end of a coupling member 115 can wrap around a respective one of the slots where a second end of the coupling member 115 can affix to the wrist attachment 112.

The coupling members 115 can be configured to detachably attach to the wrist attachments 112 and/or can be configured to detachably attach to one of the shoulder portion 106 or the chest portion 109. For instance, in embodiments in which two coupling members 115 are employed, a first coupling member 115*a* can be configured to couple a first wrist portion 112*a* to the shoulder portion 106 of the shoulder harness system 100, and a second coupling member 115*b* can be configured to couple the second wrist portion 112*b* to the chest portion 106, or vice versa, while the operator 10 is in an initial phase of a swing (e.g., when the operator 10 is in the stance position). However, the coupling members 115 are sized and positioned to detach from one or more of the components of the shoulder harness system 100, for instance, in response to a predetermined amount of force being exerted during a swing or, in other words, in response to a predetermined stage of a swing being reached.

More specifically, the coupling members 115 are sized and positioned to maintain a chest-to-arm position of the operator 10 during a stance or other preliminary phase of a swing. In some embodiments, the coupling members 115 are rigid members, such as metallic or rigid plastic members. In other embodiments, the coupling members 115 are flexible straps. In any event, the coupling members 115 are configured to detach from one of the shoulder portion 106 or the chest portion 109, for instance, in response to a predefined amount of force being exerted by the operator during a swing motion. In some embodiments, the coupling members 115 are configured detach from the wrist portions 112 instead of the shoulder portion 106 or the chest portion 109. In further embodiments, the coupling members 115 are configured detach from all of the wrist portions 112, the shoulder portion 106, and the chest portion 109. In these embodiments, the coupling members 115 can simply fall to the ground during the swing. Additional views of the shoulder harness system 100 relative to an operator 10 and swinging device 15 are shown in FIGS. 30-33.

Figure 2:
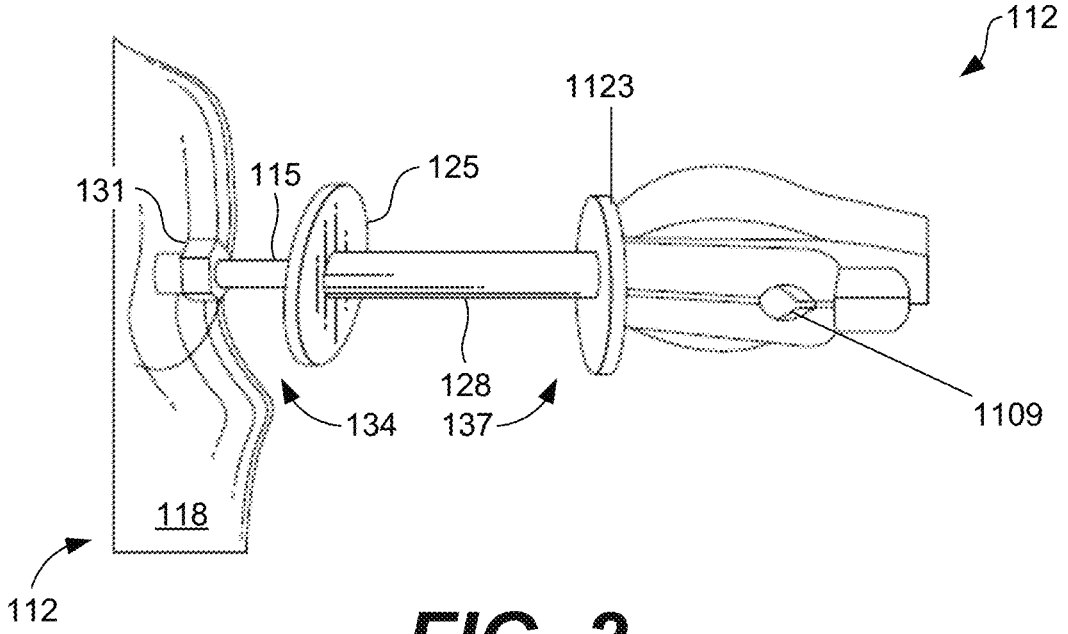
FIG. 2 is an enhanced view of the shoulder harness illustrating a coupling member according to various embodiments of the present disclosure.

Referring next to FIG. 2, an enhanced perspective view of a wrist attachment 112 and a coupling member 115 are shown. The wrist attachment 112 can include a wrist strap 118, where the coupling members 115 extend between the wrist strap 118 and a shoulder portion 106 or chest portion 109. In some embodiments, the coupling member 115 is secured to the wrist attachments 112, the shoulder portion 106, and/or the chest portion 109 using one or more magnets 125, a plurality of hook-and-loop fasteners (e.g., VELCRO), or other suitable coupling mechanism.

The shoulder harness system 100 can include a magnet 125 positioned on or near the coupling member 115. As can be appreciated, the magnet 125 creates a detachable connection with another component of the shoulder harness system 100, such as the wrist attachment 112, shoulder portion 106, and/or chest portion 109. To this end, the coupling member 115 can detachably attach to other components of the shoulder harness system 100 made of or comprising a magnetic material, such as the shoulder portion 106, the chest portion 109, or a magnet positioned in the wrist strap 118.

In some embodiments, the magnet 125 can include a circular magnet, or other suitable shape. Further, the magnet 125 can include an aperture in which the coupling member 115 is positioned such that the magnet 125 is capable of moving along a body of the coupling member 115. A rod 128, having a diameter greater than that of the coupling member 115, can prohibit movement of the magnet 125 beyond a predetermined distance. To this end, in some embodiments, the distance (and strength) of the magnet 125 from the shoulder portion 106 and/or chest portion 109 is adjustable by the operator 10. In other words, the force between the coupling member 115 and the wrist attachment 112 (or the coupling member 115 and the shoulder portion 106 or chest portion 109) is adjustable and variable.

The wrist strap 118 may include a band of material configured to be placed on the wrist of the operator 10, such as nylon, polyester, cotton, or other suitable fabric. In various embodiments, the wrist strap 118 may be made of any of a plurality of stretchable materials suitable for securing around the wrist of an operator including terrycloth fabric, moisture wicking fabric, corded fabric, plastic, silicon, other materials, and/or combinations thereof. The wrist strap 118 may be secured around the wrist of an operator by any of a plurality of connection mechanisms, such as a hook-and-loop strap, snap fasteners, elastic materials, side release buckles, other connectors, or a combination thereof.

In some embodiments, the rod 115 can include a cylindrical, longitudinally-extending member having a female threaded screw body therein. The coupling member can include a male threaded screw body that engaged with the female threaded screw body of the rod 115. A screw head 131 may retain the coupling member 115 to the wrist attachment 118 or other component in some embodiments (e.g., in embodiments in which the coupling member 115 is not detachably attachable to the wrist attachment 118).

In various embodiments, the wrist strap 118 may also include a piece of padded material positioned over the screw head 131 when the screw head 131 is positioned in the wrist strap 118. The padded material aids in securing the screw head to the wrist strap 118 and to protect the wrist of the operator.

The coupling members 115 may include a first end 134 and a second end 137. The first end 134 of the coupling member 115 can be configured to be secured to the wrist attachment 112 and the second end 137 of the coupling member 115 can be configured to detachably attach to one of the shoulder portion 106 or the chest portion 109. The coupling member 115, when coupled between the wrist attachment 112 and one of the shoulder portion 106 and the chest portion 109, is configured to maintain a chest-to-arm position of the operator 10 and detach from one of the shoulder portion 106 or the chest portion 109 in response to a predefined amount of force being exerted by the operator 10 during a swing motion.

Figure 3:
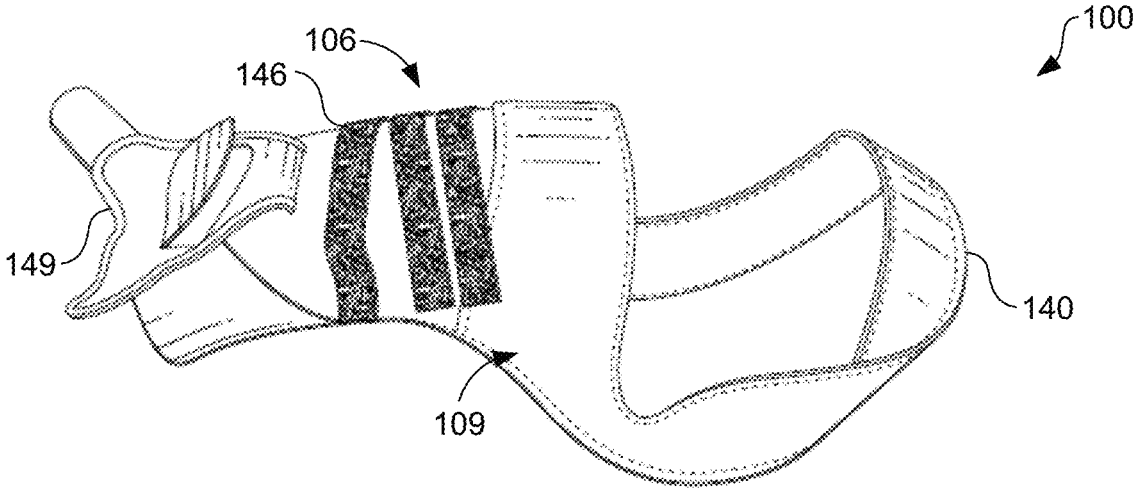
FIGS. 3-8 are various perspective views of the shoulder harness according to various embodiments of the present disclosure.
Figure 4:
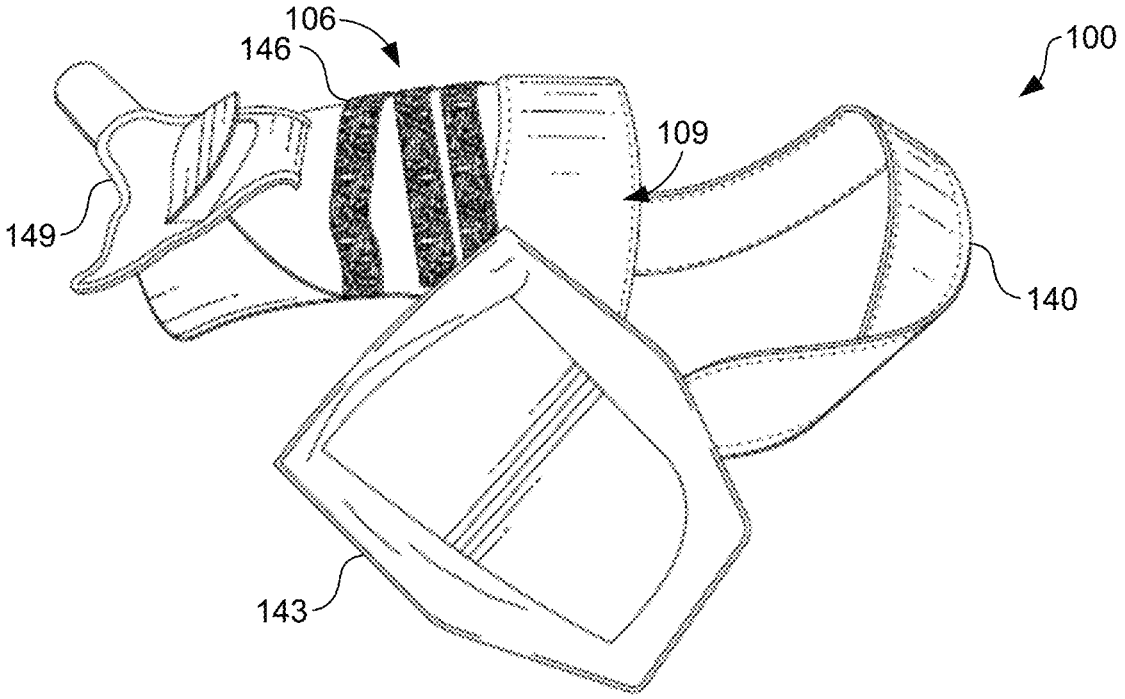

Turning now to FIGS. 3 and 4 collectively, perspective views of the shoulder harness system 100 are shown, with the coupling member 115 removed for explanatory purposes. The shoulder portion 106 of the shoulder harness system 100 may be positioned on either the right or left shoulder of an operator 10, as may be appreciated. The shoulder harness system 100 further includes a chest strap 140 that is configured to be positioned across the chest of the operator 10, for instance, under the arm opposite the shoulder on which the shoulder harness system 100 is placed, and around the back of the operator to connect to the shoulder harness system 100. A connection mechanism of the chest strap 140 may be made of any of a plurality of materials suitable for connecting to the shoulder harness system 100 including, but not limited to, hook and loop connectors, snap fasteners, side release buckles, button and buttonholes, sewed connections, other connection devices, and/or combinations thereof.

In embodiments in which a magnet 125 is used to magnetically couple the coupling member 115 between a wrist attachment 112 and the shoulder portion 106, the shoulder portion 106 can include a magnetic plate 143 that, in some examples, can be removably coupled to the shoulder harness system 100. As such, the shoulder portion 106 of the shoulder harness 109 can include a plate coupling mechanism 146, such as multiple hook-and-loop fasteners, to couple the magnetic plate 143 to the shoulder portion 106. While FIG. 3 does not show the magnetic plate 143, FIG. 3 illustrates where the magnetic plate 146 can be positioned when secured to the shoulder harness 1 system 00. For instance, the magnetic plate 146 can be positioned on top of the plate coupling mechanism 146.

The shoulder harness system 100 can further include a padded member 149 that may be configured to cover the magnetic plate 143 and the plate coupling mechanism 146 that is attached to either the shoulder portion 106 or the chest portion 109 of the shoulder harness system 100. In various embodiments, the shoulder harness system 100 may have a first padded member **146*a* located at the shoulder portion 106 and a second padded member 146*b* located at the chest portion 109 of the chest strap 113. In other embodiments, additional layers of padding may be added or removed to the padded member 146 to increase or decrease the coupling force of the wrist attachment 112, as will be discussed, to the at least one coupling section 143. In various embodiments, the magnetic plate 143 and/or the magnet 125** may be at least partially made of a material suitable for magnetic coupling, such as stainless steel, iron, aluminum, other materials, and/or a combination thereof.

As noted above, in various embodiments, the shoulder harness system 100 may include a single chest strap 140 that wraps around the front chest of the operator 10, under an opposite arm, around the back of the operator 10, and reattaches to the shoulder harness system 100 using a suitable coupling mechanism. In other embodiments, the chest strap 140 may include multiple straps configured to wrap around the operator 10, such as the torso of the operator 10, and detachably attach to the shoulder harness system 100 by any of a plurality of attaching mechanisms, including hook-and-loop fasteners, snap fasteners, side release buckles, other devices, and/or combinations thereof. To this end, the shoulder harness system 100 may be worn on either the right or left shoulder of an operator 10 and the chest strap 140 can be wrapped around the torso of the operator 10 and, for instance, under the opposite arm.

The wrist attachment 112 may include an inner portion and an outer portion. The inner portion of the wrist attachment 112 may include a piece of fabric or other padded material configured to secure over the screw head 131, or other suitable connector, positioned on the inner side of the wrist strap 118. Furthermore, the inner material may partially provide padding for the wrist of the operator 10 from the screw head 131 or other connector. The inner portion of the wrist strap 118 may be made of any of a plurality of materials including, but not limited to, foam, felt, other fabric materials, and/or a combination thereof. The outer portion of the wrist strap 118 can include banded material that secures around the wrist of the operator 10. The outer portion may be made of any of a plurality of materials including moisture-wicking fabric or other materials. In various embodiments, the wrist attachment may secure around the wrist of an operator 10 by any of a plurality of connection mechanisms including but not limited to being partly made of an elastic material, a side release buckle, a snap fastener, hook and loop connector, other means, and a combination thereof.

Figure 5:
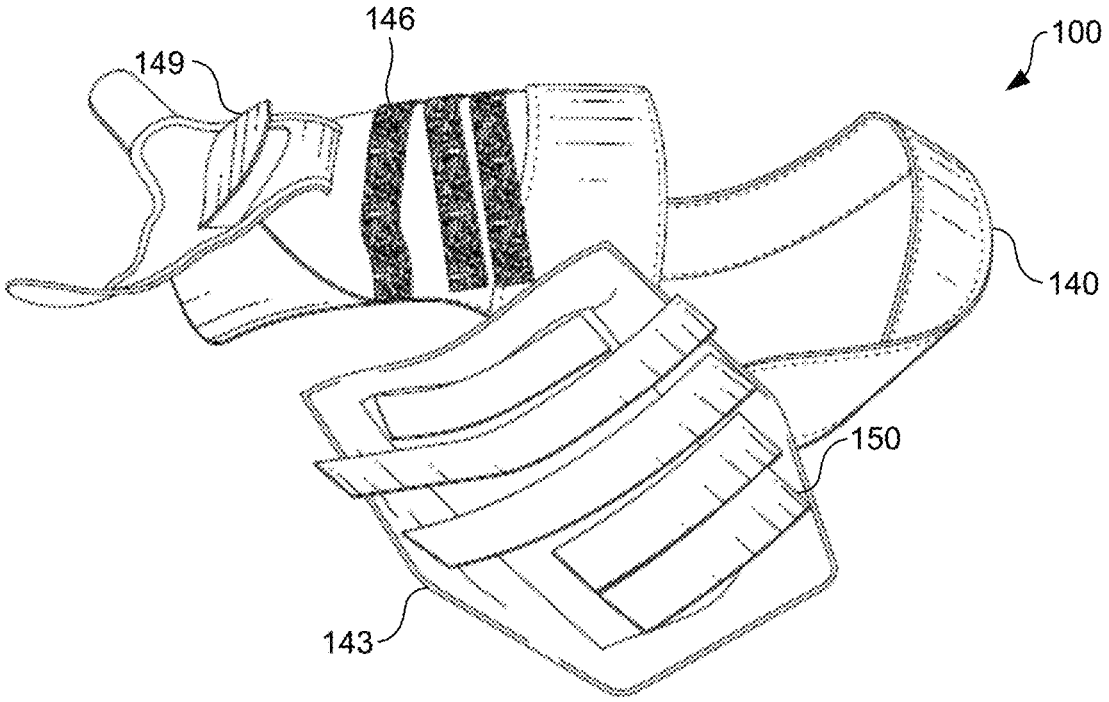
Figure 6:
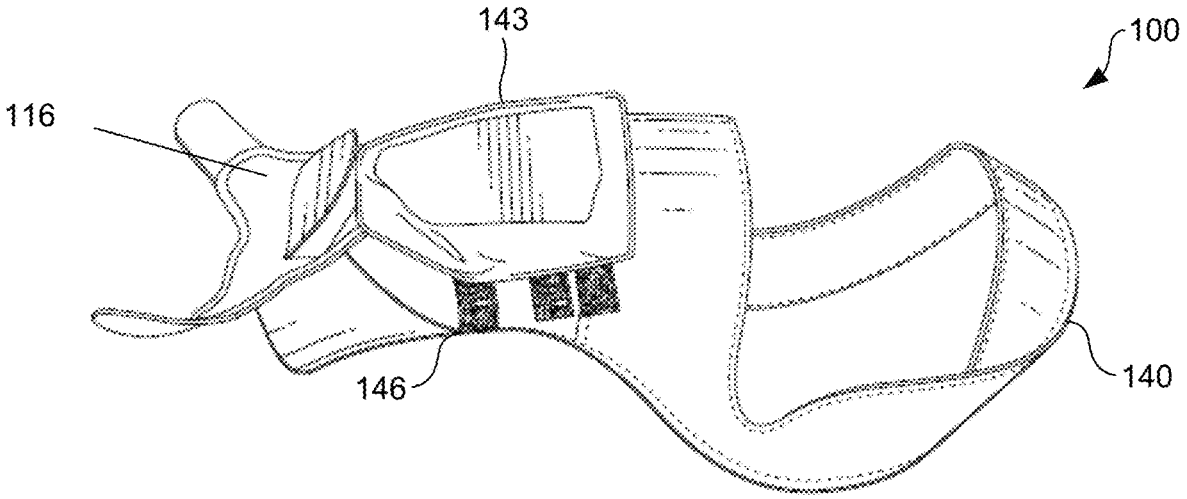

Turning now to FIG. 5, the magnetic plate 143 is shown having fasteners 150 (e.g., hook-and-loop fasteners) that engage with the plate coupling mechanism 146 to secure the magnetic plate 143 to the shoulder harness system 100. FIG. 6 shows the magnetic plate 143 being positioned on the shoulder harness system 100, such that the magnetic plate 143 can be used to form a magnetic coupling with the coupling member 115.

In various embodiments, the magnet 125 and/or the magnetic plate 143 can include a predetermined magnetic field strength. Referring back to FIG. 2, in various embodiments, the magnet 125 may be interchanged with other magnets of varying magnetic field strengths to adjust the force required to decouple the wrist attachment 112 from the shoulder harness system 100 by the operator 10 while performing a swing action. In other embodiments, the coupling member 115 may be formed of a magnetic material such that the coupling member 115 itself has magnetic characteristics.

In some embodiments, the shoulder harness system 100 may include a noise emitting device (not shown) that may be configured to emit a noise when a predetermined event occurs. In various embodiments, the noise emitting device may be a bell and clapper, wherein the clapper is a cylindrical member that surrounds the connector and slidably moves along the length of the connector to strike a bell that is located on the coupling member 115. Thus, the noise emitting device may emit a noise when the coupling member 115 decouples from the shoulder harness system 100 by a force being exerted on the wrist attachment 112, thereby causing the clapper to strike the bell. As can be appreciated, a ringing of the bell or other noise emitted by the noise emitting device can instruct the operator 10 of the stage of the swing in which the coupling member 115 is released from the shoulder harness system 100.

In other embodiments, the noise emitting device may include an electronic device comprising at least one electronic circuit (or computing device, such as a microcontroller) that comprises, or is otherwise coupled to, a speaker by any number of a plurality of communication mediums including a physical connection, BLUETOOTH®, WI-FI®, other communication mediums, or a combination thereof. In some embodiments, the shoulder harness system 100 includes a sensor (e.g., radar, laser, resistance sensor, etc.) that detects when the coupling member 115 has decoupled from the shoulder harness and emits a noise via the speaker in response thereto.

Figure 7:
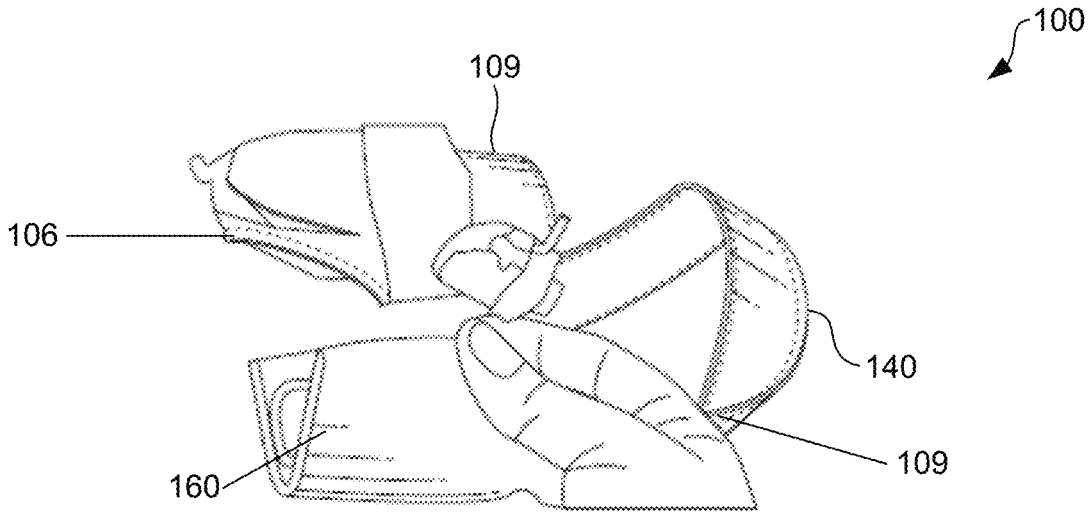
Figure 8:
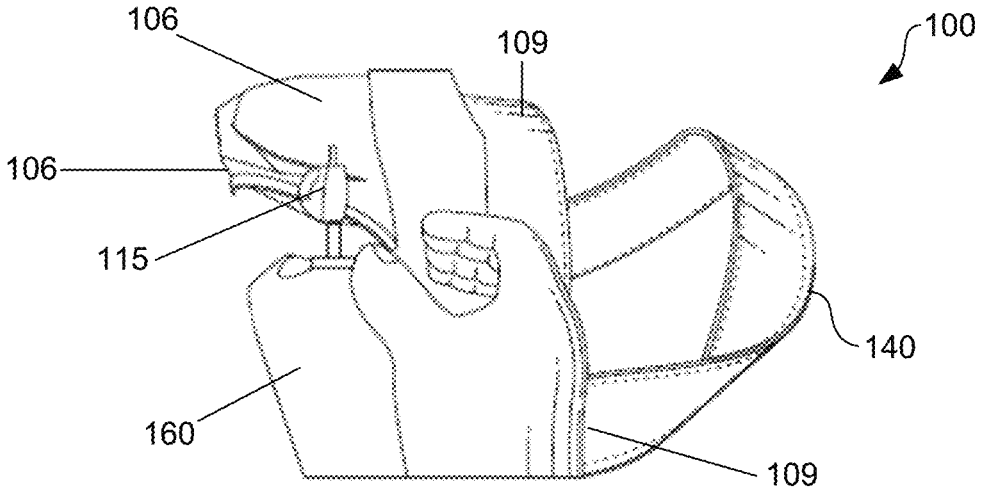

FIGS. 7-12 show various perspective views of the shoulder harness system 100. More specifically, FIGS. 7 and 8 show an operator 10 attaching an auxiliary coupling section 160 to the chest portion 109 of the shoulder harness system 100. In various embodiments, the auxiliary coupling section 160 may be attached to any location along the length of the chest strap 140 as the shoulder harness system 100 may be worn on either the right or left shoulder of the operator 10. Consequently, the auxiliary coupling section 160 may need to be repositioned on the chest strap 140, for instance, depending on whether the shoulder harness system 100 is worn on the left or right shoulder of the operator 10 so that the operator 10 may couple at least one wrist attachment 112 to the auxiliary coupling portion 160. Furthermore, the auxiliary coupling section 160 may be attached to the chest portion 109 by any of a plurality of attaching mechanisms, including hook and loop connectors, snap fasteners, side release buckles, other fasteners, other connectors, and/or combinations thereof.

Figure 9A:
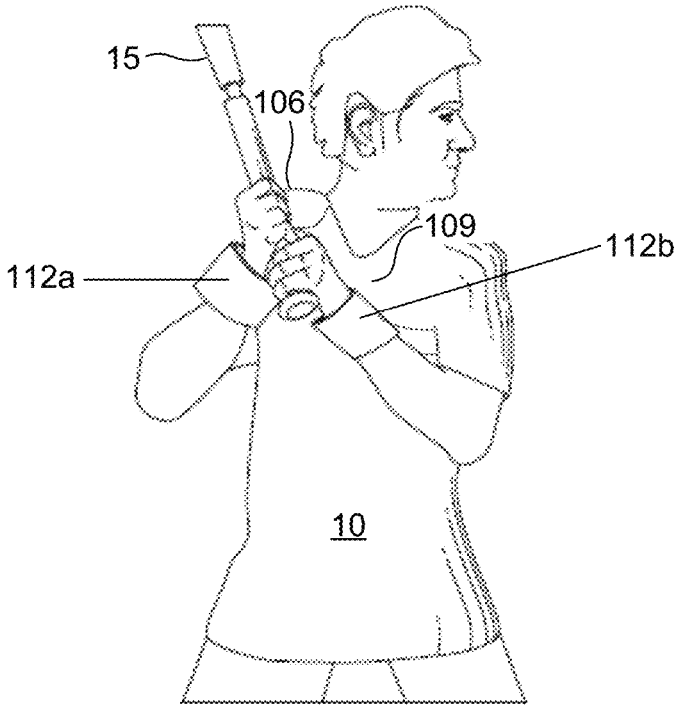
FIGS. 9A-9C illustrate various views of a swing cycle with an operator wearing the shoulder harness according to various embodiments of the present disclosure.
Figure 9B:
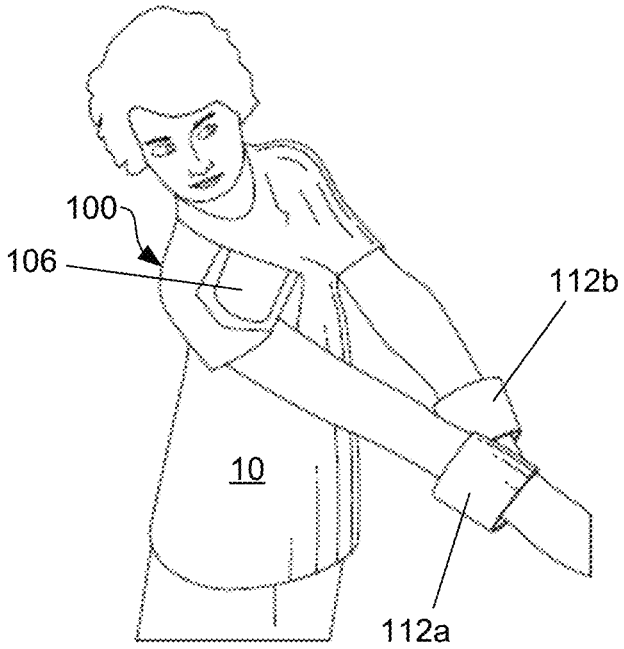
Figure 9C:
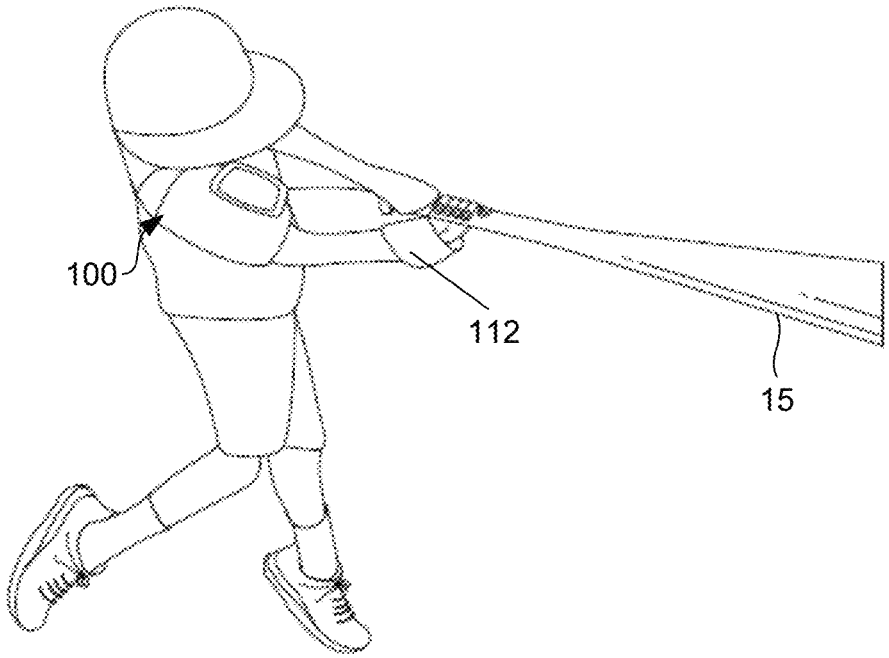

Now, operation of the shoulder harness system 100 relative to an operator 10 (a person wearing the shoulder harness system 100) is discussed. Referring to FIGS. 9A-9C, an operator 10 is shown in various stages of a swing sequence while wearing the shoulder harness system 100. More specifically, FIG. 9A shows an operator 10 in the stance stage of the swing sequence while wearing the shoulder harness system 100. Next, FIG. 9B shows the operator 10 in the swing acceleration stage of the swing sequence while wearing the shoulder harness system 100. Notably, the coupling members 115 are sized and positioned to maintain an arm-to-chest position, or other similar relative positioning, in a stance stage and a swing acceleration stage until a predetermined amount of force is exerted during the swing or, in other words, in response to a predetermined stage of a swing being reached. FIG. 9C shows the operator 10 in the follow through stage of the swing sequence while wearing the shoulder harness system 100.

In various embodiments, each of the first wrist attachment **112*a* and the second wrist attachment 112*b* are detachably attached to the shoulder portion 106 and the chest portion 109, respectively. When the operator 10 of a swinging device, such as a baseball bat, progresses through the stages of the swing, the first wrist attachment 112*a* and the second wrist attachment 112*b* are configured to break away from and detach from the shoulder portion 106 and the chest portion 109 of the shoulder harness system 100**.

Specifically, the first wrist attachment **112*a* and the second wrist attachment 112*b*, and the coupling member(s) 115** attached thereto, are configured to detach from the shoulder harness system 100 at a predetermined point when the operator 10 exerts a predetermined amount of force upon the first wrist attachment 112*a* and the second wrist attachment 112*b* while the operator 10 progresses from the stance stage, through the coiling phase, and into the swing initiation phase and the arms of the operator accelerate from a predetermined position and into the swing acceleration stage of the swing.

Figure 10:
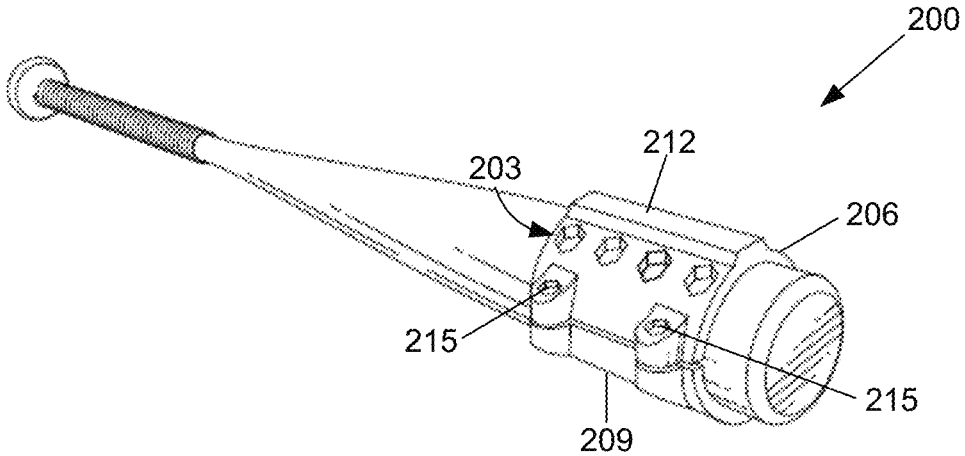
FIG. 10 illustrates a battle ax that may be used with or in place of the shoulder harness according to various embodiments of the present disclosure.

Referring to FIG. 10, a barrel ax 200 is shown in accordance with various embodiments of the disclosure, where the barrel ax 200 may be employed with or in place of the shoulder harness system 100. The barrel ax 200 includes a cylindrical collar body 203 that may include a first portion 206 (e.g., a first half), a second portion 209 (e.g., a second half), and an elongated surface 212 projecting from the cylindrical collar body 203. In some embodiments, the barrel ax 200 includes a clamping portion 212 located on each longitudinal end of each of the first portion 206 and the second portion 209. The barrel ax 200 emulates a real axe, requiring the operator 10 to make contact with a narrow range of the projecting, elongated surface 212, the ideal location of the baseball bat or other swinging device.

As may be appreciated, and as shown in FIG. 10, the first portion 206 and the second portion 209 of the cylindrical collar body 203 may be configured to affix to and clamp around a swing device, such as a baseball bat, golf club, cricket bat, or other swinging device. In various embodiments, each of the first portion 206 and the second portion 209 may include a clamping portion 215, where the clamping portion 215 of the first portion 206 is configured to align with the clamping portion 215 of the second portion 209 to secure around the shaft of a swinging device.

In other embodiments the battle ax 200 may be configured to secure around the shaft of a swinging device by a plurality of clamping means including bolts, straps, connectors, other means, and/or a combination thereof. In various embodiments of the present disclosure, the inner surface of each of the first portion 206 and the inner surface of the second portion 209 may also include a padded material that consists of foam, silicon, felt, other materials, or combinations thereof that aid the battle ax 200 to grip the swinging device and to prevent the battle ax 200 from damaging the swinging device, further dampening impact with a baseball or other object. The elongated surface 212 projecting from the body of the barrel ax 200 is configured to provide an operator 10 with a visual indicator of the alignment of the swinging device throughout the swing device. Thus, giving visual feedback to the operator 10 of whether the operator 10 is making square contact with an object throughout the swing sequence.

In other embodiments, the barrel axe 200 may be a substantially flat raised segment that has fabric material on the ends configured to secure around the shaft of a swinging device. The substantially flat raised segment may be directly placed on a surface of a swinging device and attached to the swinging device by any of a plurality of means including hook and loop straps, side release buckles, snap fasteners, other means, and/or a combination thereof. The raised segment may perpendicularly extend from the surface of the swinging device and may be intended to contact an object. The raised segment may also provide an indication to an operator of when the swinging device is making "square" contact with an object during the swing sequence.

In further embodiments, the edge of the barrel ax 200 can include a noise emitting device that emits noise or performs a similar function. To this end, in some embodiments, the barrel axe 200 can include two plates separated by a spring or any other method to create a noise when a ball strikes the edge of the barrel ax 200.

Figure 11:
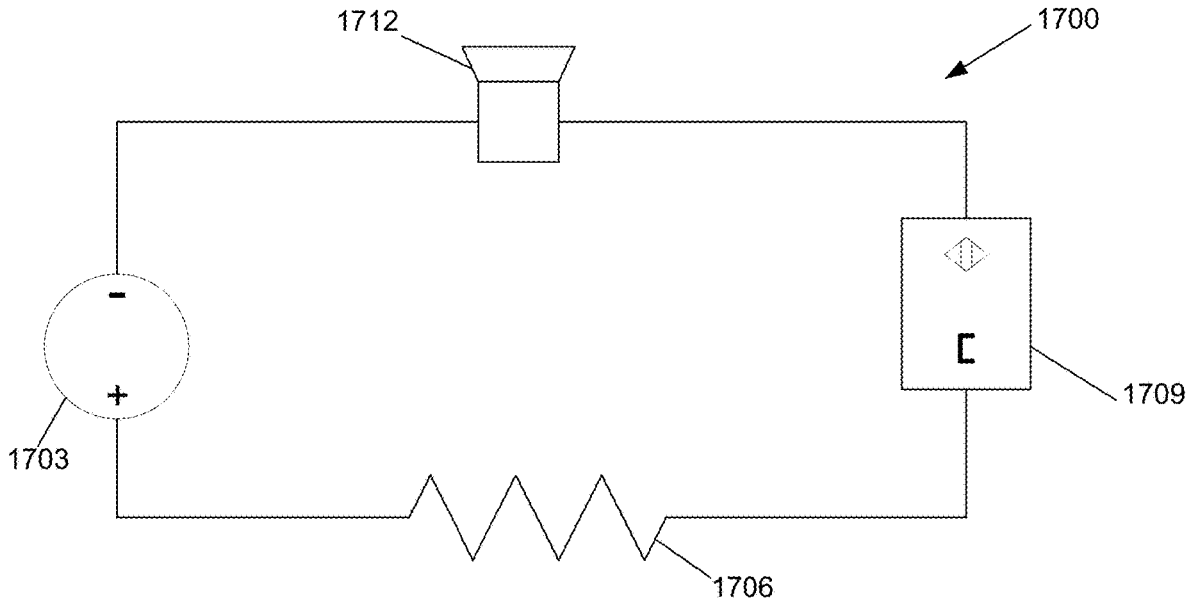
FIG. 11 is an example of a circuit for a noise emitting device that may be implemented in the shoulder harness according to various embodiments of the present disclosure.

Referring to FIG. 11, shown is an example of an electronic circuit 1700 that may be one possible embodiment of the noise emitting device 1115, 1123 for the at least one wrist attachment 1103. The electronic circuit may include at least a power source 1703, a resistor 1706, a sensor 1709, and a speaker 1712. The power source 1703 may be any of a plurality of power sources 1703 suitable for powering an electronic circuit including a battery. In various embodiments of the present disclosure, the sensor 1709 may be a magnetic sensor wherein the magnetic sensor detects when the wrist attachment 1103 decouples from either the first coupling section 203 or the second coupling section 206. Furthermore, in other embodiments, the electronic circuit 1700 may be capable of connecting to external speakers via any of a plurality of means to emit a noise to alert the operator of a predetermined event. The electronic circuit may connect to an external speaker through wired connection, Wi-Fi, Bluetooth, other means, and/or a combination thereof.

Figure 12A:
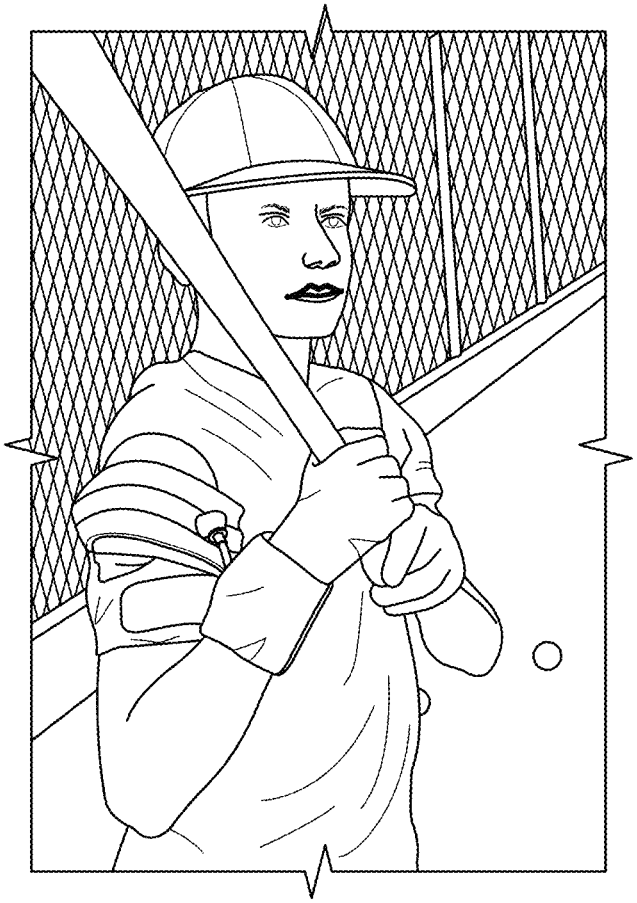
FIGS. 12A and 12B illustrate various views of a swing cycle with an operator wearing the shoulder harness according to various embodiments of the present disclosure.
Figure 12B:
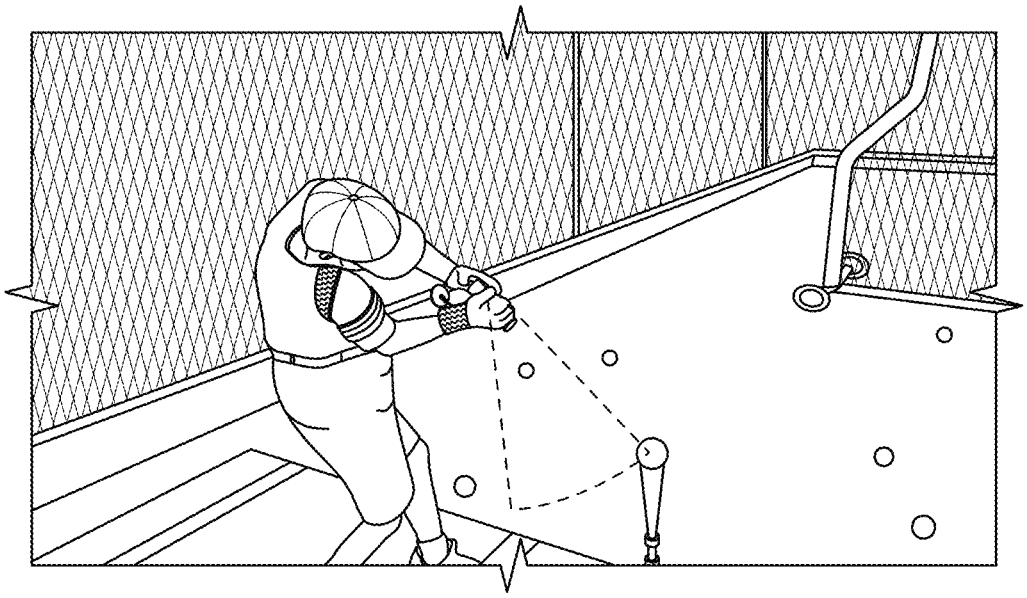

Referring to FIGS. 12A and 12B, an operator 10 is shown in various stages of a swing sequence while wearing the shoulder harness system 100. Again, the coupling members 115 are sized and positioned to maintain an arm-to-chest position, or other similar relative positioning, in a stance stage and a swing acceleration stage until a predetermined amount of force is exerted during the swing or, in other words, in response to a predetermined stage of a swing being reached.

As can be appreciated, in embodiments in which hook-and-loop fasteners (e.g., VELCRO) are employed, when separated or ripped apart during a swing, a substantial noise is emitted, letting the operator 10 know of the separation. When the noise is heard, this can help the operator 10 realize when they are engaging the hands to the ball.

In embodiments in which magnets are employed, the operator 10 can hear the magnet click when they connect the coupling member 115 to the wrist attachment 112 and/or the shoulder portion 106 or chest portion 109. The fact that the operator 10 does not have to start with a connected apparatus is distinguishable from prior systems. Instead, the operator 10 can connect the hook-and-loop, magnetic, or other fasteners in the swing with ease. Further, if the operator 10 starts with his hands low or high they time the toe touch (which is the stride landing) with the magnet clicking the shoulder portion 106 or the chest portion 109 (e.g., in instances in which the shoulder portion 106 or the chest portion 106 include metal).

In some embodiments, the wrist attachment 112 has a base screw which connects to the desired region the operator 10 desires. The shoulder harness system 100 places focus on the shoulder instead of the rotator cuff. Further, in some embodiments, the magnets can simply be changed with stronger pull force which will strengthen the whip action during a swing.

While many embodiments of the present disclosure relate to a swinging motion for baseball, the shoulder harness system 100 is not limited to swinging activities or sports that require swinging motions. For instance, in some embodiments, the shoulder harness system 100 can be employed to assist when arm-to-body positioning for throwing motions, such as pitching in baseball, cricket, and other sports require overhead throwing motions.

Notably, with respect to batting and swinging motions, the shoulder harness system 100 can provide a short bat path, which teaches young and veteran players where to hold bat and trains muscle memory (muscle memory movements). The shoulder harness system 100 provides players and coaches with an entire region on the outside portion of the shoulder to choose a comfortable position for each player's needs. For instance, players have different arm lengths and growth spurts that require adjustable hand positions for player comfort.

Figure 13:
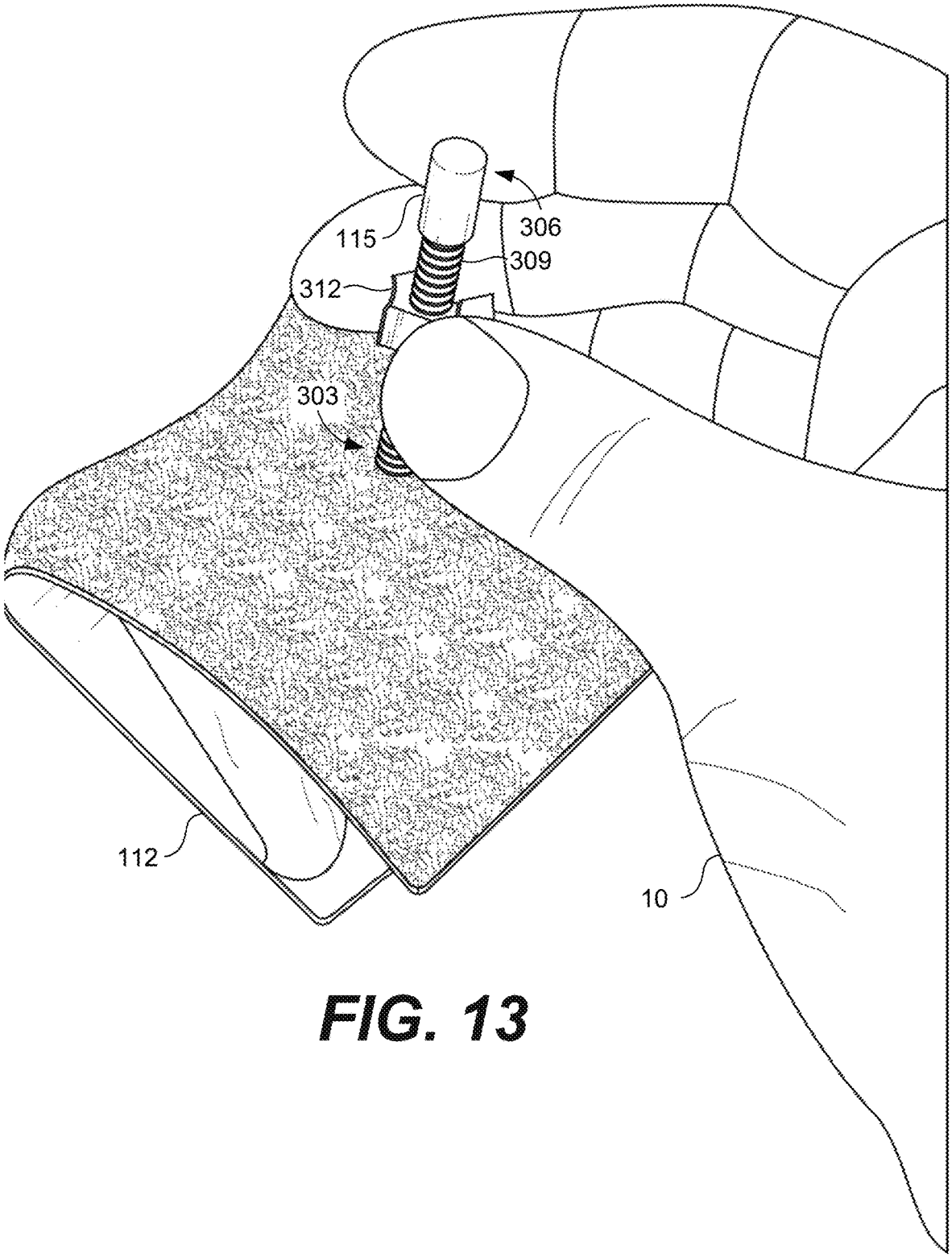
FIGS. 13 and 14 illustrate various enhanced views of a wrist band and a coupling member according to various embodiments of the present disclosure.

Turning now to FIGS. 12 and 13, enhanced views of a wrist attachment 112 and a coupling member 115 are shown. As noted above, the coupling member may include a first end 303 and a second end 306. The first end 303 of the coupling member 115 can be configured to be secured to the wrist attachment 112, and the second end 306 of the coupling member 115 can be configured to detachably attach to one of: the shoulder portion 106 or the chest portion 109. The coupling member 115 is configured to maintain a chest-to-arm position of the operator 10 and detach from one of the shoulder portion 106 or the chest portion 109 (and/or the wrist attachment 112) in response to a predefined amount of force being exerted by the operator 10 during a swing motion.

In some embodiments, the coupling member 115 can include a vertically-protruding body 309 having a head (not shown) positioned on an inside of the wrist attachment 112, where the vertically-protruding body projects out of a recess or other aperture in the wrist attachment 112. The head can have a body wider than the vertically-protruding body 309 (and wider than the aperture) to secure the coupling member 115, whereas a nut 312 or similar device can secure the coupling member 115 to the wrist attachment 112. As such, in some embodiments, the vertically-protruding body 309 includes a threaded vertically-protruding body on which a nut 312 can be threadably coupled.

Figure 14:
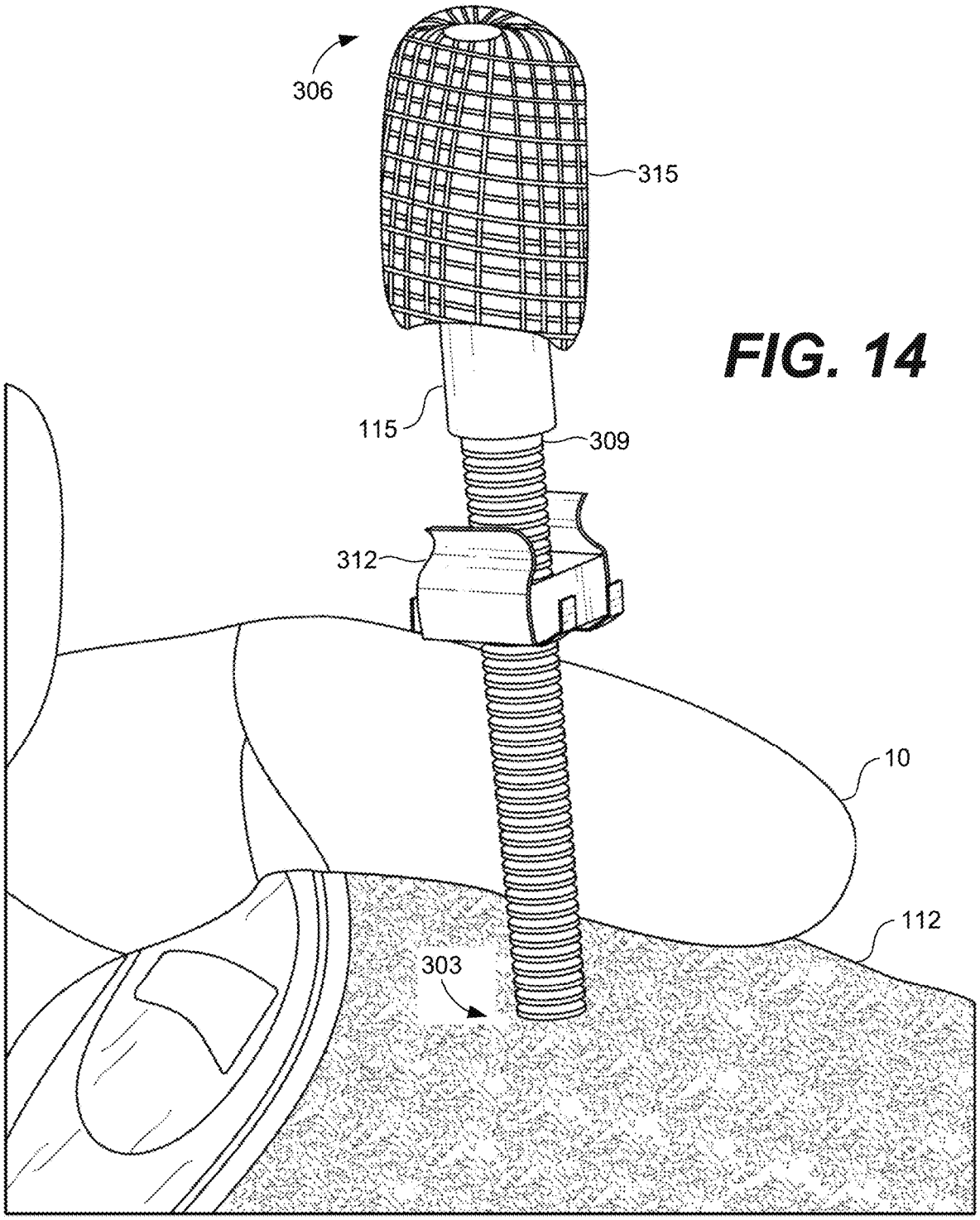

Specifically, FIG. 14 shows an attachment device 315 positioned on a distal end of the coupling member 115 (e.g., the second end 306). The attachment device 315 can include a magnet in some embodiments. However, in some embodiments, the attachment device 315 includes a hook-and-loop fastener, such as Velcro®.

As the hook-and-loop fasteners of the attachment device 315 is included therewith, players who disconnect their hands before the big muscles transfer energy, will be able to hear the mistake, thereby also making coaching more effective. The ripping noise should be heard near contact. Further, in embodiments, in which magnets are employed, a noise is made when connecting to a metal plate on the shoulder portion 106 or the chest portion 109. Advanced players can use this feature to use the noise for timing the "separation" and landing phase of swing. The magnets can be interchangeable with stronger magnets, creating stronger whip action resulting in exit velocity. This can also be considered a strength trainer for the square whip contact through ball. The wristbands will have interchangeable screws for players and coaches desired hand position in stance. Some players want their hands closer to body and some like more space. Some may want to experiment. With the spacing system, players can train to find the position that works for them best. As such, in some embodiments, the attachment device 315 can include any magnetic or non-magnetic device that emits a sound when attached or detached from the shoulder portion 106 or the chest portion 109.

Figure 15:
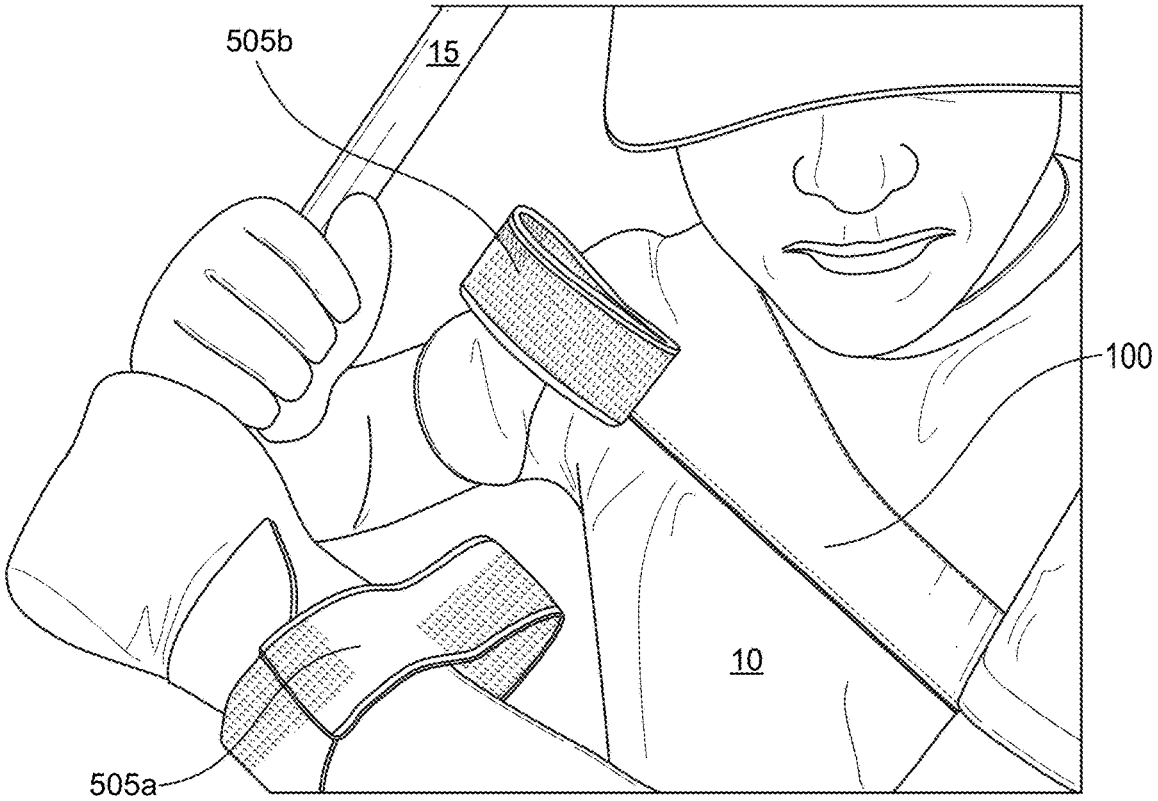
FIG. 15 is a photograph showing an operator wearing a shoulder harness and a double-sided hook-and-loop fastening strip that comprises hook-and-loop fasteners on both sides that can be worn as a wristband according to various embodiments of the present disclosure.
Figure 16:
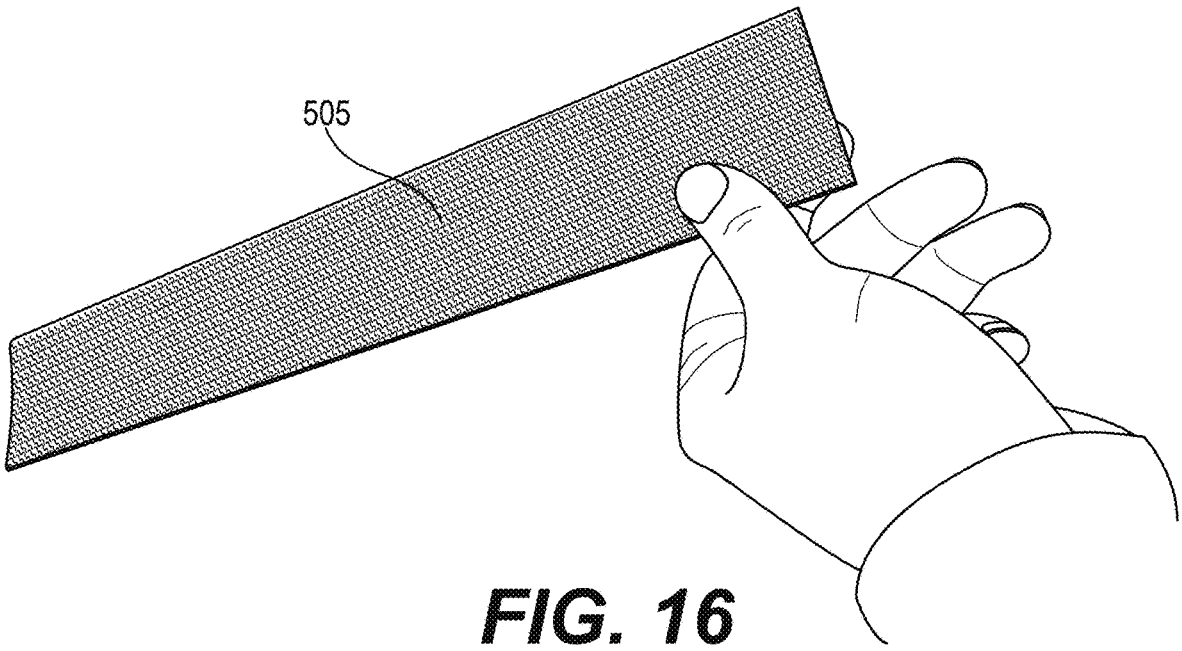
FIG. 16 is a photograph of the wristband of FIG. 15 that comprises hook-and-loop fasteners on both sides according to various embodiments of the present disclosure.
Figure 17:
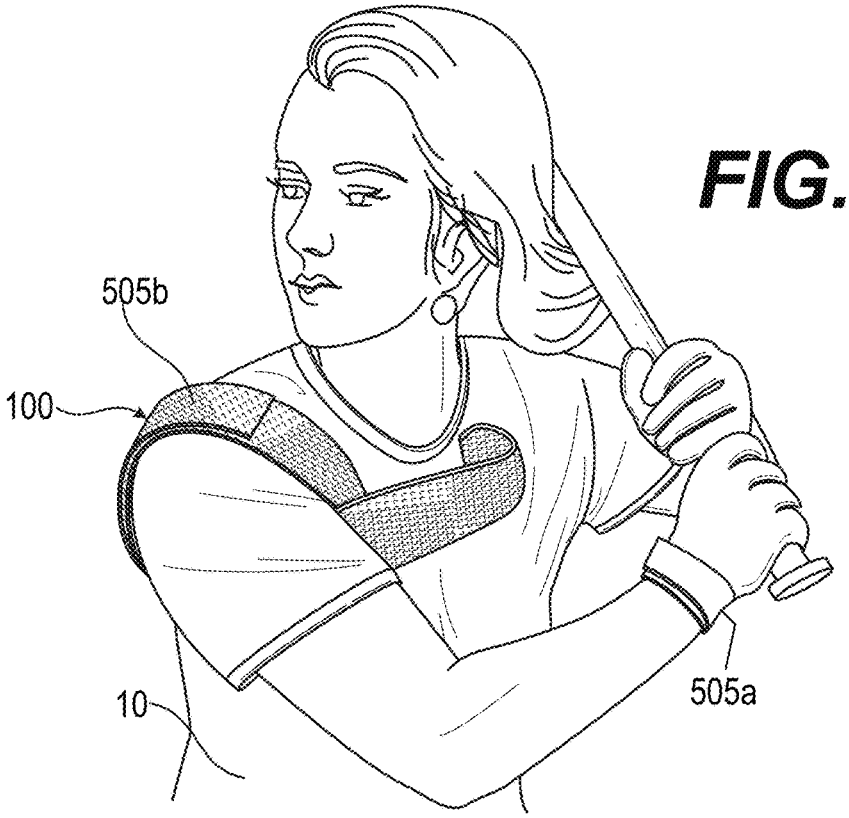
FIG. 17 is a photograph showing an operator wearing a shoulder harness and a double-sided hook-and-loop fastening strip that comprises hook-and-loop fasteners on both sides that can be worn over a lead shoulder according to various embodiments of the present disclosure.

Turning now to FIG. 15, a photograph is shown that includes an operator 10, such as a baseball player, softball player, cricket player, or other athlete, wearing the shoulder harness system 100. In various embodiments, the shoulder harness system 100 may include double-sided hook-and-loop fastening strips 505*a*, 505*b*. A top side of the double-sided hook-and-loop fastening strips 505 is shown in FIG. 16. Referring to FIGS. 15 and 16 collectively, each of the double-sided hook-and-loop fastening strips 505 may include a flat, longitudinally extending body having hook-and-loop fasteners, for instance, on both the top side and the bottom side. As such, a first one of the hook-and-loop fastening strips 505*a* may be worn as a wristband, as shown in FIG. 15, whereas a second one of the hook-and-loop fastening strips 505*b* can also be placed over a lead shoulder to facilitate a follow through motion, as shown in FIGS. 15 and 17. The hook-and-loop fastening strips 505 are sized and positioned such that the width around the wrist and/or the shoulder can be adjusted.

Accordingly, the coupling members 115 of the shoulder harness system 100 can include the hook-and-loop fastening strips 505 in some embodiments. More specifically, the hook-and-loop fastening strips 505 can be configured to detachably attach to the wrist and/or can be configured to detachably attach to one of the shoulder portion 106 or the chest portion 109. For instance, in embodiments in which two hook-and-loop fastening strips 505 are employed, a first one of the hook-and-loop fastening strips 505*a* can be configured to couple a wrist portion 112 to the shoulder portion 106 of the shoulder harness system 100 via the second one of the hook-and-loop fastening strips 505*b*, while the operator 10 is in an initial phase of a swing (e.g., when the operator 10 is in the stance position). However, the coupling members 115 are sized and positioned to detach from one or more of the components of the shoulder harness system 100, for instance, in response to a predetermined amount of force being exerted during a swing or, in other words, in response to a predetermined stage of a swing being reached.

The hook-and-loop fastening strip 505 can also be placed over a lead shoulder to facilitate a follow through motion, as shown in FIG. 17. Specifically, FIG. 17 is a photograph showing an operator 10 wearing the shoulder harness system 100 and the hook-and-loop fastening strip 505 that comprises hook-and-loop fasteners on both sides. The hook-and-loop fastening strip 505 is shown being worn over a lead shoulder of the operator 10.

Figure 18:
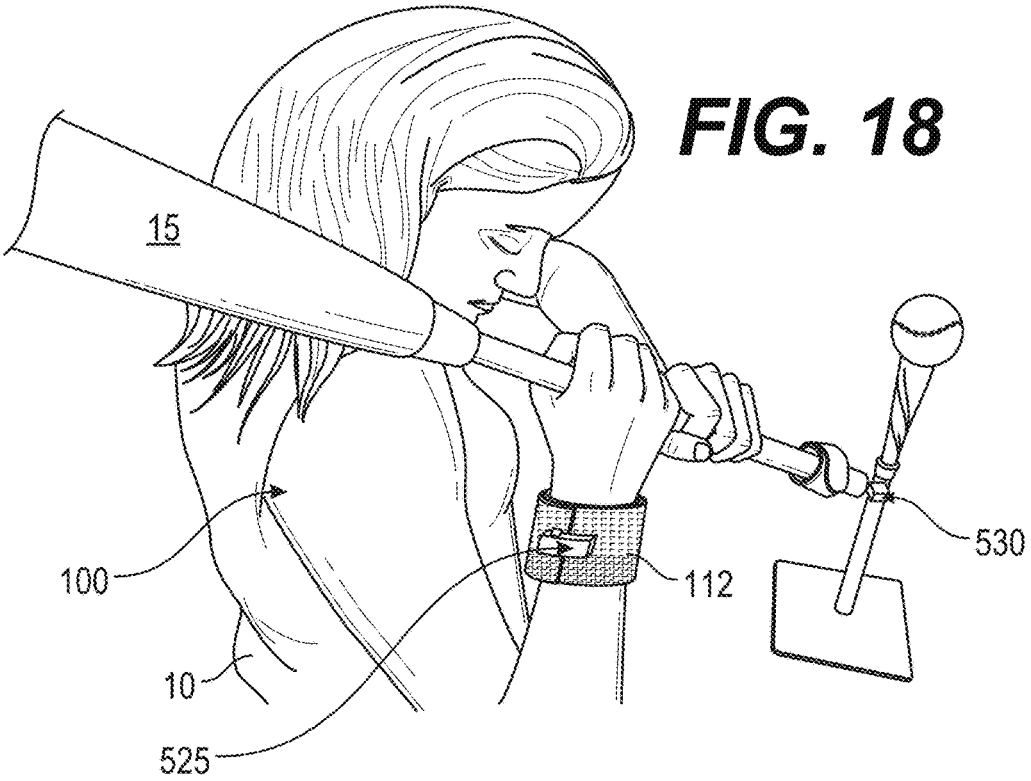
FIGS. 18 and 19 are photographs showing operators wearing a shoulder harness having a light system according to various embodiments of the present disclosure.
Figure 19:
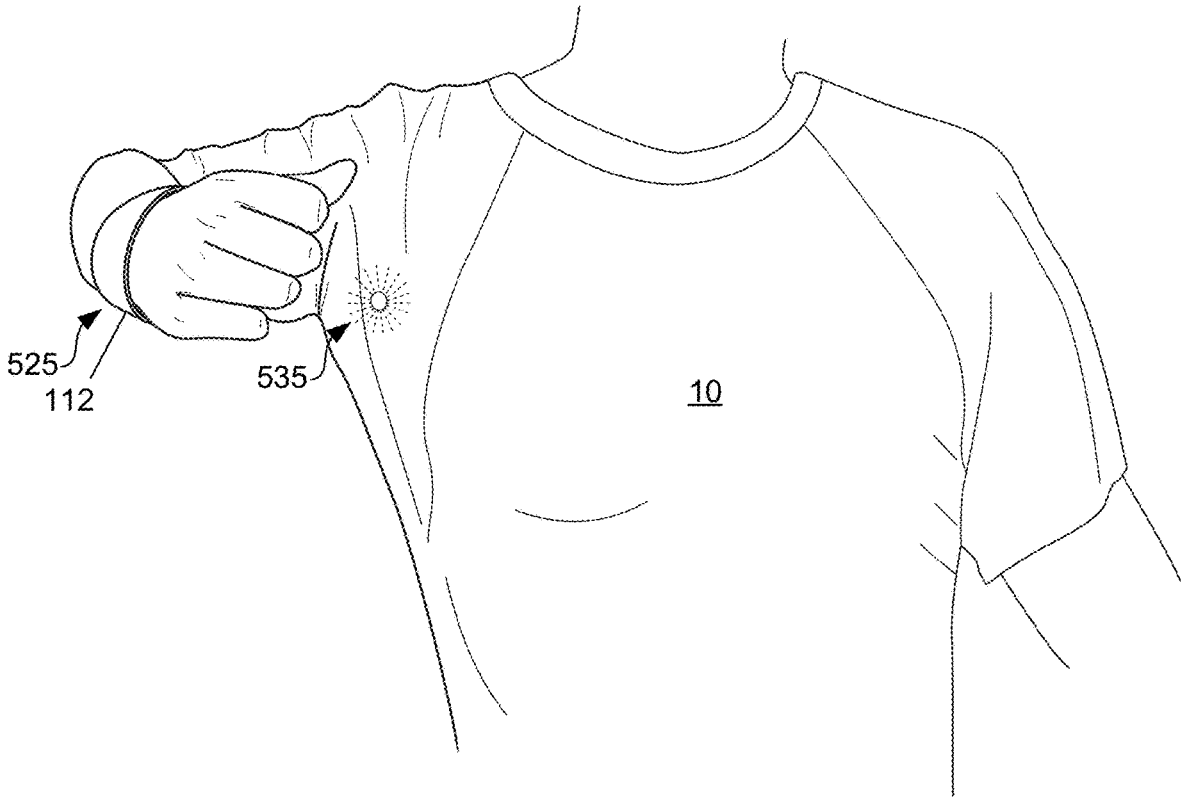

In further embodiments, the shoulder harness system 100 may include, or be used in conjunction with, a light system 520. FIGS. 18 and 19 are photographs showing operators 100 wearing the shoulder harness system 100, where the shoulder harness system 100 includes the light system 520 according to various embodiments of the present disclosure. In various examples, the light system 520 includes a first light emitting device 525 and/or a second light emitting device 530 affixed to the operator 10, swinging device 15, or a part of the swing training system 100.

As shown in the non-limiting example of FIG. 18, the first light emitting device 525 may be positioned on the wrist attachment 112, such that, when the operator 10 conducts a swing, a light beam shines across a chest or other desired location of the operator 10. In some embodiments, the first light emitting device 525 includes a clip or other connecting device configured to attach to a side or distal end of the wrist attachment 112. In further embodiments, the first light emitting device 525 is coupled to the wrist attachment 112 via hook-and-loop fasteners or other suitable connection mechanism.

Similarly, in some embodiments, the second light emitting device 530 includes a clip, hook-and-loop fastener, or other connecting device configured to attach to the second light emitting device 525 to a bottom, distal end of a swinging device, such as a baseball bat, softball bat, golf club, tennis racket, cricket bat, or other device.

Each of the first light emitting device 525 and the second light emitting device 530 can include a switch, a battery, and a light emitting element, such as a light emitting diode (LED) or a laser device (e.g., a laser pointing device). In some embodiments, the first light emitting device 525 emits light of a first color (e.g., red) while the second light emitting device 530 emits light of a second color (e.g., blue). In some embodiments, each of the first light emitting device 525 and the second light emitting device 530 can be toggled via the switch to adjust the color being emitted by the LED or other light emitting element.

During a swing operation, the first light emitting device 525 is sized and positioned on the wrist attachment 112 such that light emitted by the first light emitting device 525 shines across the chest, for instance, during an initial stage of a swing as well as during a majority of the swing operation. Photographs or videos of the operator 10 can be captured and the course of the light appearing across the chest, or other body surface area of the operator 10, can be monitored to analyze a swing.

The second light emitting device 530 is sized and positioned on the bat such that light emitted from the second light emitting device 530 points at a ground surface, for example, towards a ball or field they want to hit to, incentivizing the operator 10 to whip the light from the knob back to the chest. In further embodiments, a series of lines or markings on a mat or ground surface can be implemented to create dots that the operator 10 connects with light emitted from the second light emitting device 530 affixed to the bottom of the bat.

Figure 20:
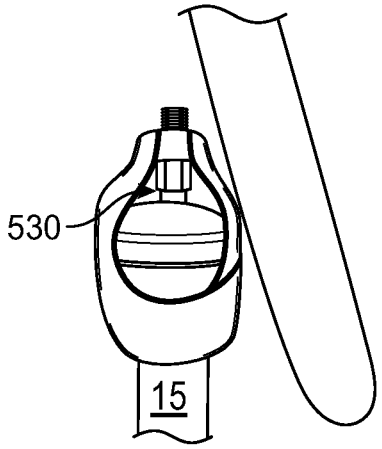
FIGS. 20 and 21 are photographs showing illustrating the light system described herein according to various embodiments of the present disclosure.
Figure 21:
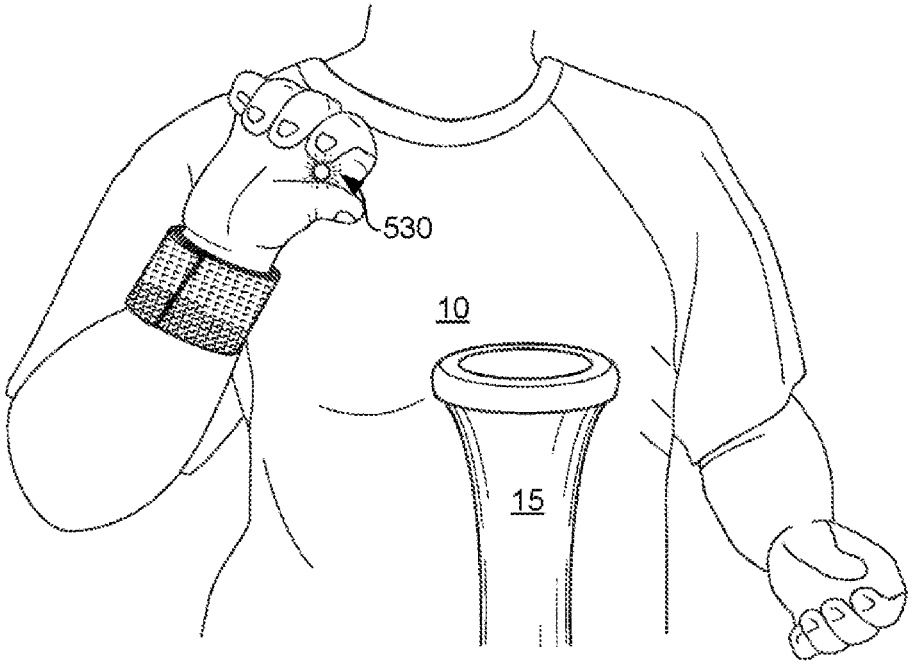

FIGS. 19, 20, and 21 are photographs showing illustrating the light system described herein according to various embodiments of the present disclosure. FIG. 19 illustrates a wrist attachment 112 having a first light emitting device 525 coupled thereto, that emits a beam of light 535 on the operator 10. FIG. 20 shows the second light emitting device 530 coupled to a bottom end of a swinging device 15, such as a bat, using one or more hook-and-loop fasteners to emit a beam of light. The second light emitting device 530 is shown as being decoupled from the swinging device 15 in FIG. 21.

In various embodiments, a laser light map may be employed. For instance, a metal disk, a series of metal discs, or other appropriate material may create a path for lights on the light emitting devices 525, 530 to follow during a swing, essentially simplifying the training for the player in any sport. The metal disk or other object may be positioned on the operator 10 or on a ground surface. As such, the shoulder harness system 100 may be used for baseball, softball, tennis, badminton, lacrosse, cricket, etc.

In some embodiments, the light system 520 can be used to point and direct a ball towards a direction of a light or laser beam. Imagine, for example, a rifle scope on the front side arm aiming at a target. A light emitting device 525 can attach to the wrist attachment 120 for the purpose of aiming the ball. Additionally, the light emitting device 525 can be affixed to various positions on a bat or other swinging device 115, including the top cap to light the area where a barrel of the bat or other swinging device 115 will point towards.

Figure 22:
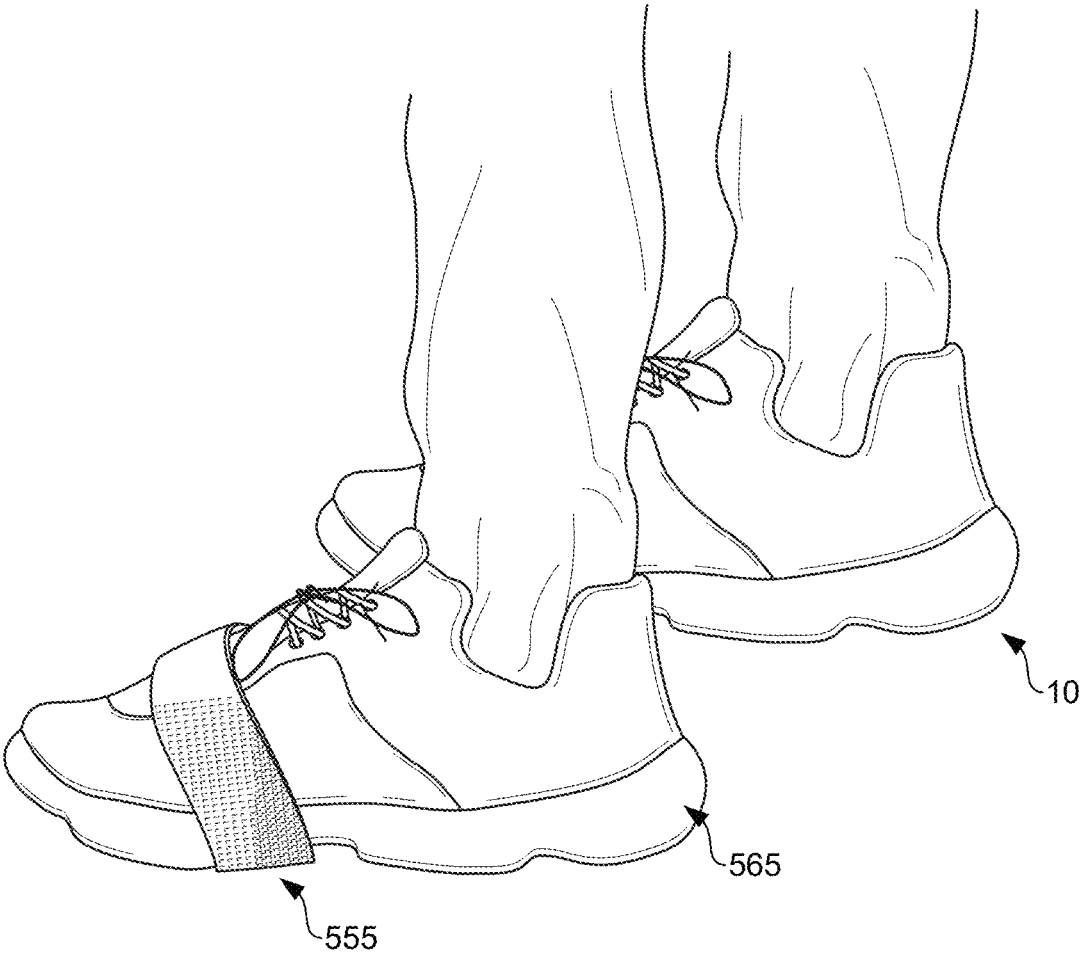
FIG. 22 is a photograph of an operator using a stride training system according to various embodiments of the present disclosure.

FIG. 22 is a photograph of an operator 10 using a stride training system 550 that can be used independent of or in conjunction with the shoulder harness system 100 described herein according to various embodiments of the present disclosure. The stride training system 550 can include a foot harness 555 that secures a foot magnet 560, for instance, to a bottom of a shoe 565 or foot of the operator 10, as well as a target magnet plate 570.

Figure 23:
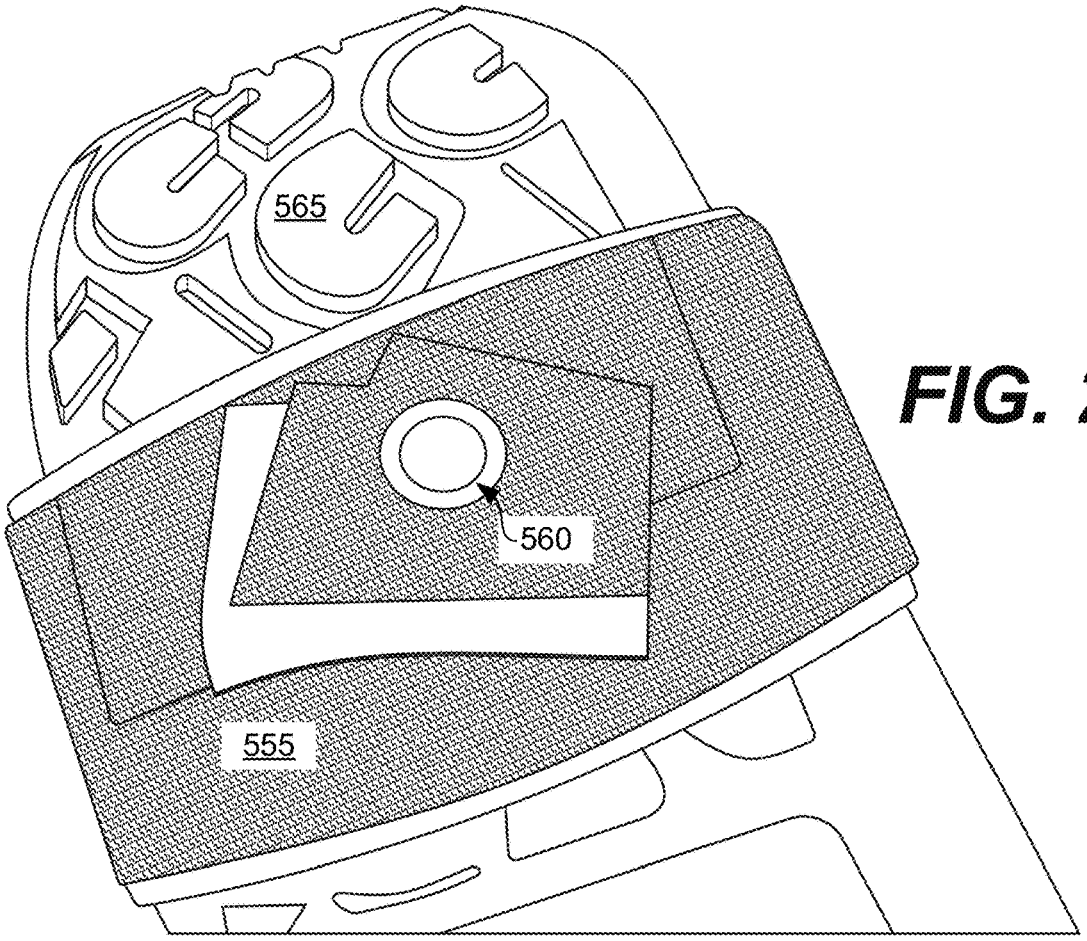
FIG. 23 is a photograph of a bottom of a shoe of an operator, where a magnet is positioned on the bottom of the shoe for use in the stride training system of FIG. 22 according to various embodiments of the present disclosure.
Figure 24:
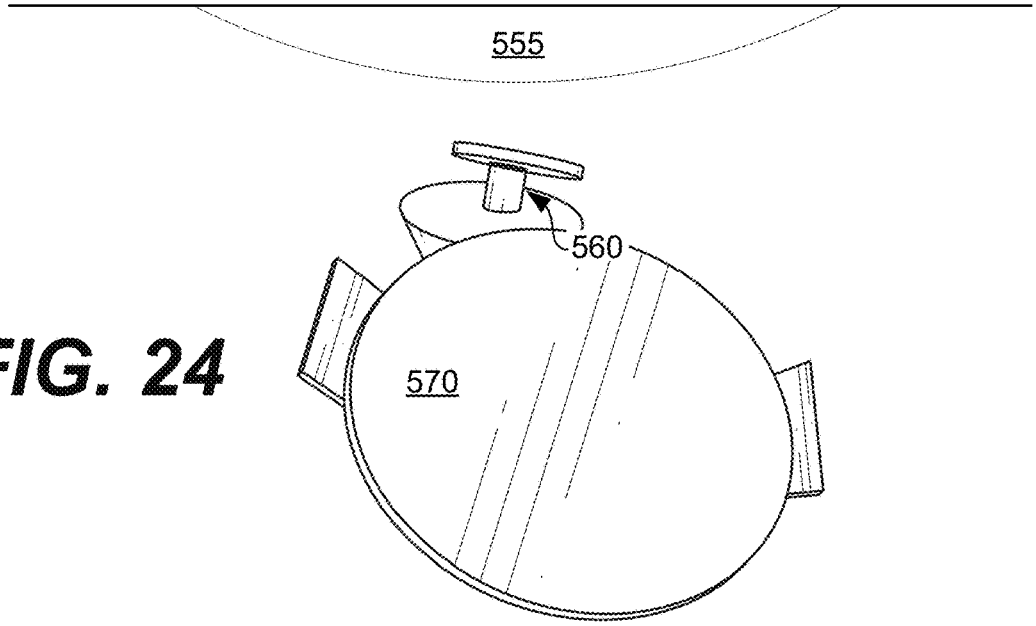
FIG. 24 is a photograph of a target magnet for use in the stride training system of FIG. 22 according to various embodiments of the present disclosure.
Figure 25:
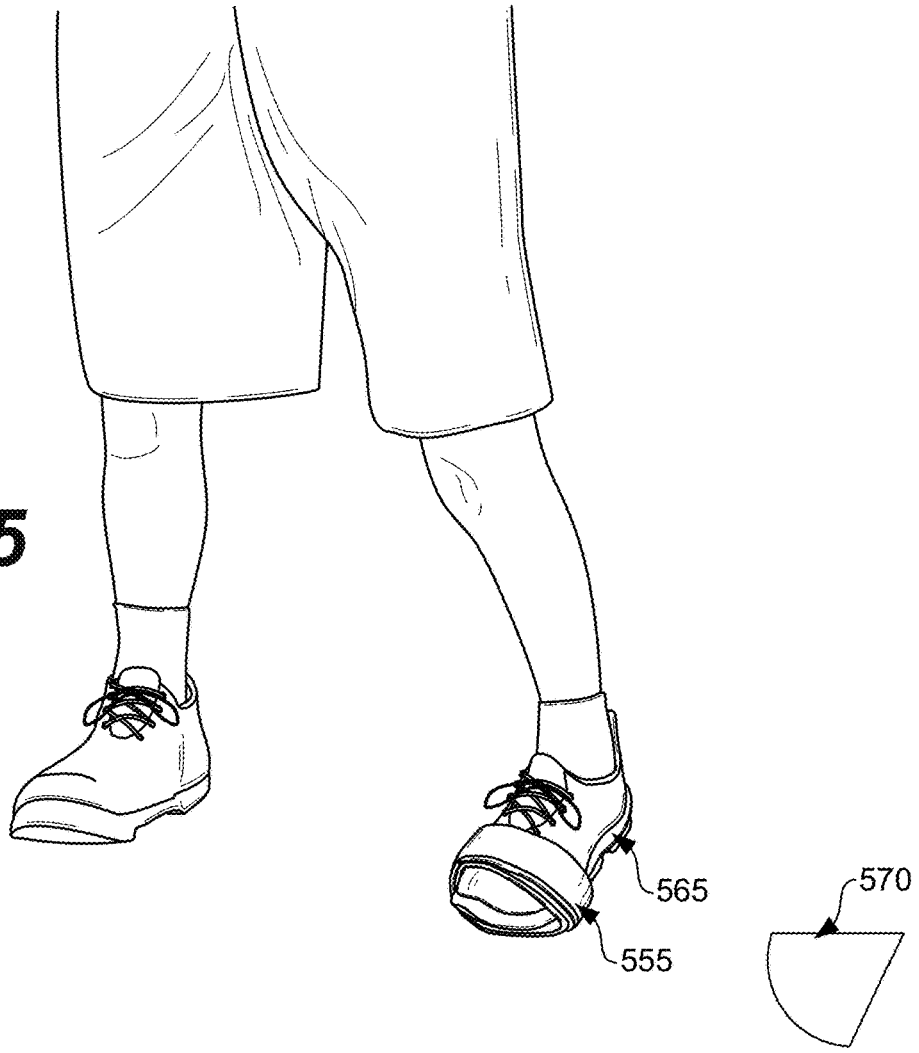
FIGS. 25 and 26 are photographs showing an operator using the stride training system according to various embodiments of the present disclosure.
Figure 26:
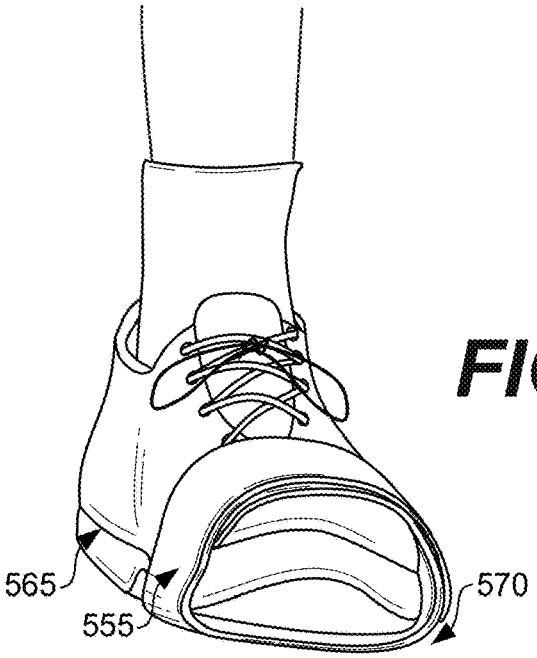

FIG. 23 is a photograph of a bottom of a shoe of the operator 10, where the foot magnet 560 is shown being positioned on the bottom of the shoe for use in the stride training system 550 of FIG. 22 according to various embodiments of the present disclosure. FIG. 24 is a photograph of a target magnet plate 570 for use in the stride training system 550 of FIG. 22 according to various embodiments of the present disclosure. FIGS. 25 and 26 are photographs showing an operator 10 using the stride training system 550 according to various embodiments of the present disclosure.

Referring to FIGS. 22-26 collectively, the foot magnet 560 can be secured to the foot harness 555 using a hook-and-loop fastening strip in various embodiments. A portion of the hook-and-loop fastening strip may be removed, for instance, to provide an aperture (e.g., a circular-shaped aperture) in or through which the foot magnet 560 can be positioned such that the foot magnet 560 can come into contact with and magnetically couple to the target magnet plate 570.

As shown in FIG. 25, the target magnet plate 570 can be set a predetermined distance on a ground surface from a lead foot of the operator 10, requiring the operator 10 to step forward and make contact with the target magnet plate 570 during a swing. The materials of the target magnet plate 570, the foot harness 555, the foot magnet 560 and other components of the stride training system 550 can be selected such that, when contact is made, an audible noise is emitted, notifying the operator 10 of successful contact. In further embodiments, a small electrical circuit can be employed with a small speaker to emit an audible noise upon successful contact (e.g., through a change in impedance of a change of resistance as may be appreciated).

In further embodiments, the stride training system 550 can also work on the back foot as well as the front foot, and the target magnet plate 570 can be placed in front of the back foot behind the back foot, in front of the front foot, or behind the front foot, for instance, depending on what the objective of the operator 10.

While the embodiments described above include a batter using the stride training system 550, it is understood that the stride training system 550 can also work with throwing motions, such as an overhead or underhand throw (e.g., a baseball or softball pitch, a cricket bowl, or other similar action). To this end, the target magnet plate 570 can be set a predetermined distance on a ground surface from a lead foot of the operator 10, requiring the operator 10 to step forward and make contact with the target magnet plate 570 during a pitching motion. When contact is made, an audible noise is emitted, notifying the operator 10 of successful contact.

Figure 34:
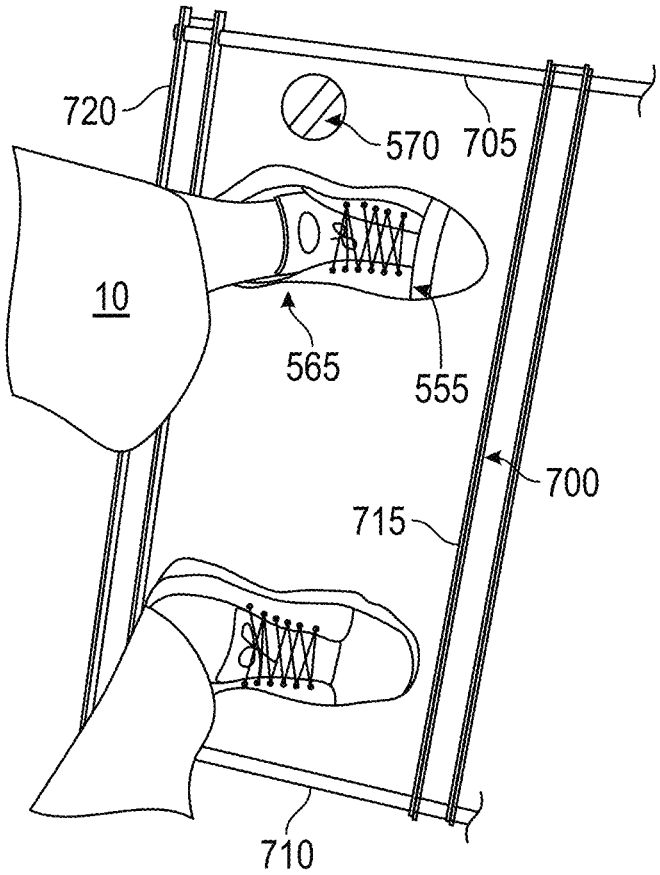
FIG. 34 is a photograph of a stride box for the stride training system described herein according to various embodiments of the present disclosure.

In further embodiments, the stride training system 550 can be used with a stride box 700, as shown in FIG. 34. The stride box 700 includes a plurality of members oriented relative to each other that define a space in which a stride of a swing takes place by the operator 10 using the stride training system 550. For instance, the stride box 700 can prevent the operator 10 from stepping beyond a predefined distance and can include a rectangular or square-shaped box. The stride box 700 includes a first member 705 and a second member 710 that are parallel to one another, as well as a third member 715 and a fourth member 720 also parallel to one another. The third member 715 and the fourth member 720 are perpendicular to the first member 705 and the second member 710. In some embodiments, the first member 705, the second member 710, the third member 715, and the fourth member 720 are adjustable relative to one another and detachably attached to one another. As such, the stride box 700 can be adjusted to an operator 10 based on their stride length.

In some embodiments, the third member 715 (e.g., the front bar) can be removed to allow for an opening or a foot landing. In some embodiments, the fourth member 720 (e.g., the rear bar) can be similarly removed to allow for an opening or a foot landing. To this end, in some embodiments, the stride box 700 can have one end opened and/or closed as desired. Additionally, the stride box 700 can be used with pitching motions, as opposed to purely batting or swinging motions. The stride box 700 can be formed of PVC, metal, or other suitable material.

Figure 27:
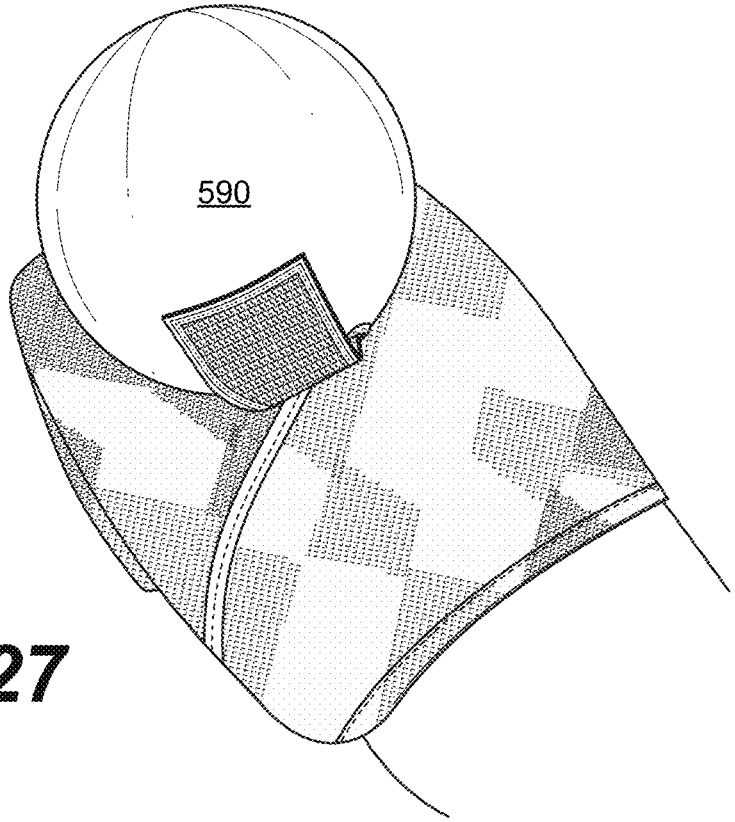
FIG. 27 is a photograph of a ball that can be connected to a vest or a shirt of an operator player to rest a bat or club next to a desired position on the body according to various embodiments of the present disclosure.

FIG. 27 is a photograph of a ball 590 that can be connected to a vest or a shirt of an operator 10, for instance, to rest a swinging device 15 (e.g., bat or club) next to a desired position on the body according to various embodiments of the present disclosure, which maintains an ideal degree of separation between the operator 10 and the swinging device 15. In some embodiments, the ball 590 attaches to the shoulder portion of the shoulder harness system 100. In addition to the ball 590, other objects may be coupled thereon that a player desires to connect such that the operator 10 can maintain a comfortable connection to the body.

Specifically, the ball or object can be a replacement for the wrist attachment 112. For instance, an operator 10 can press a swinging device 15 to the ball 590 or similar object and work on maintaining that connection to an appropriate point in a swing. For instance, a baseball bat can press against the ball 590 in a batter's stance.

Figure 28:
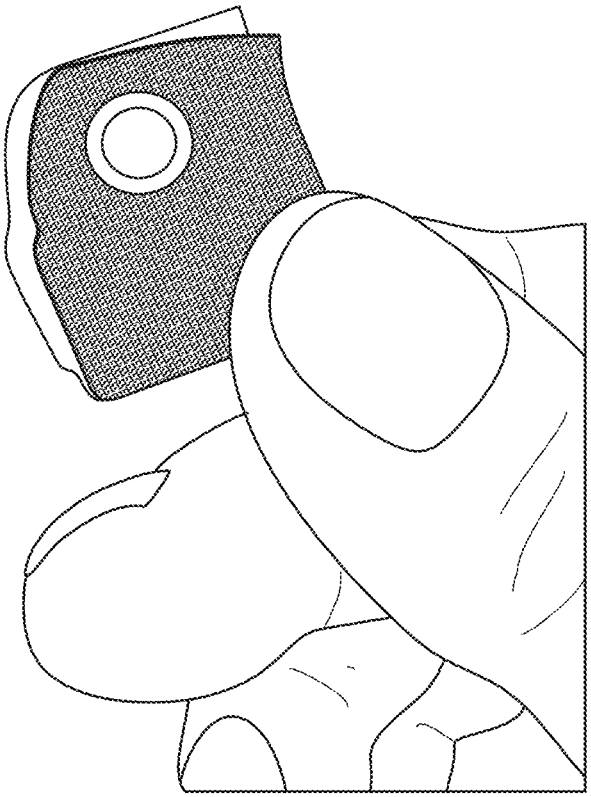
FIG. 28 is a photograph of a magnetic attachment for use with the wrist band of the shoulder harness system described herein according to various embodiments of the present disclosure.

FIG. 28 is a photograph of a magnetic attachment for use with the wrist band 112 of the shoulder harness system 100 described herein according to various embodiments of the present disclosure. Specifically, a wrist and/or foot band as described herein can include a magnet receptacle to connect to a hook-and-loop fastener strip with a magnet disposed therein.

Figure 29:
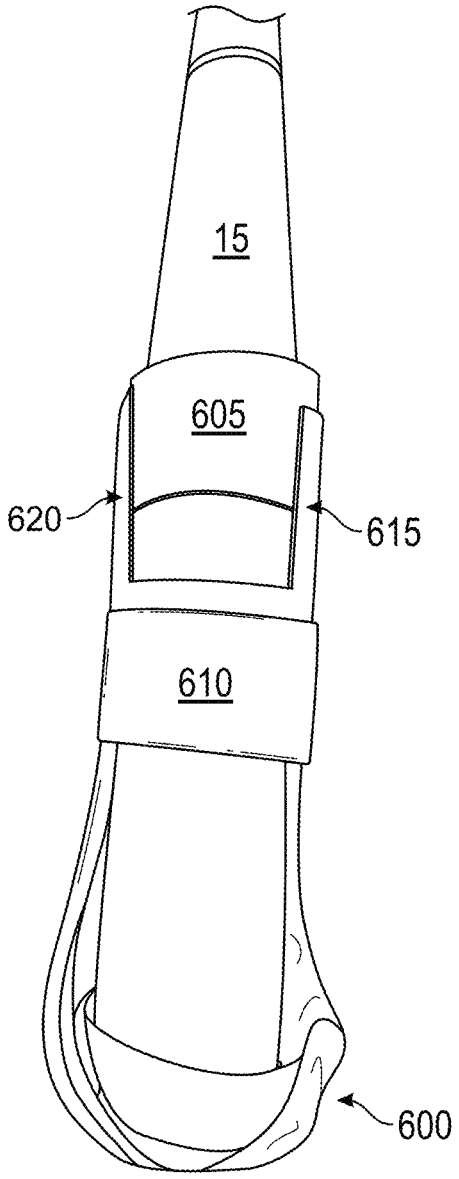
FIG. 29 is a photograph of a swinging device attachment for use with a swinging device and the shoulder harness system described herein according to various embodiments of the present disclosure.
Figure 30:
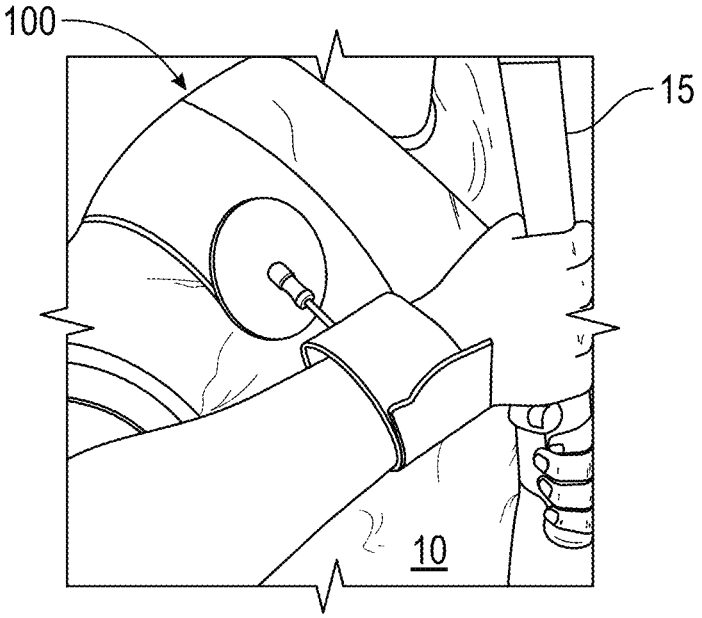
FIGS. 30-33 are various photographs of the shoulder harness system worn on an operator and shown relative to a swinging device according to various embodiments of the present disclosure.
Figure 31:
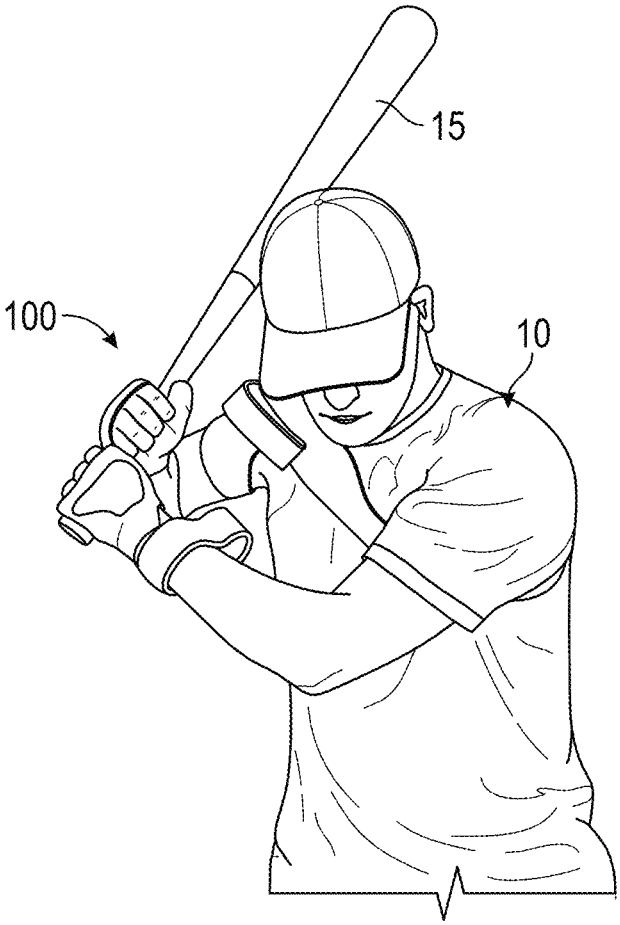
Figure 32:
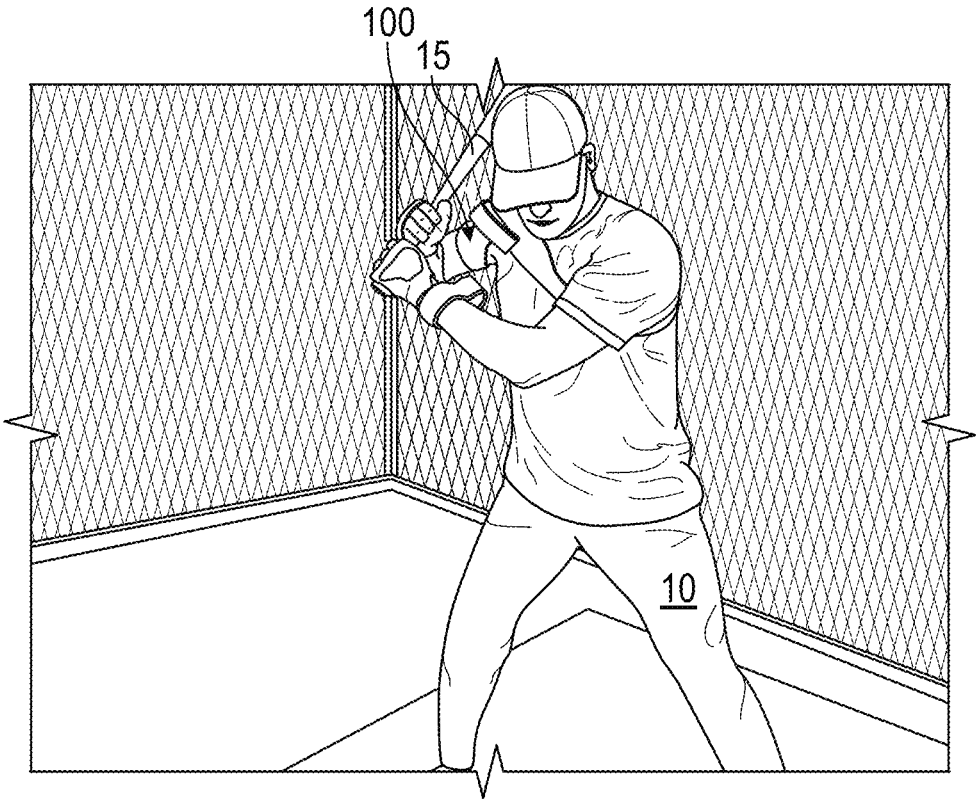
Figure 33:
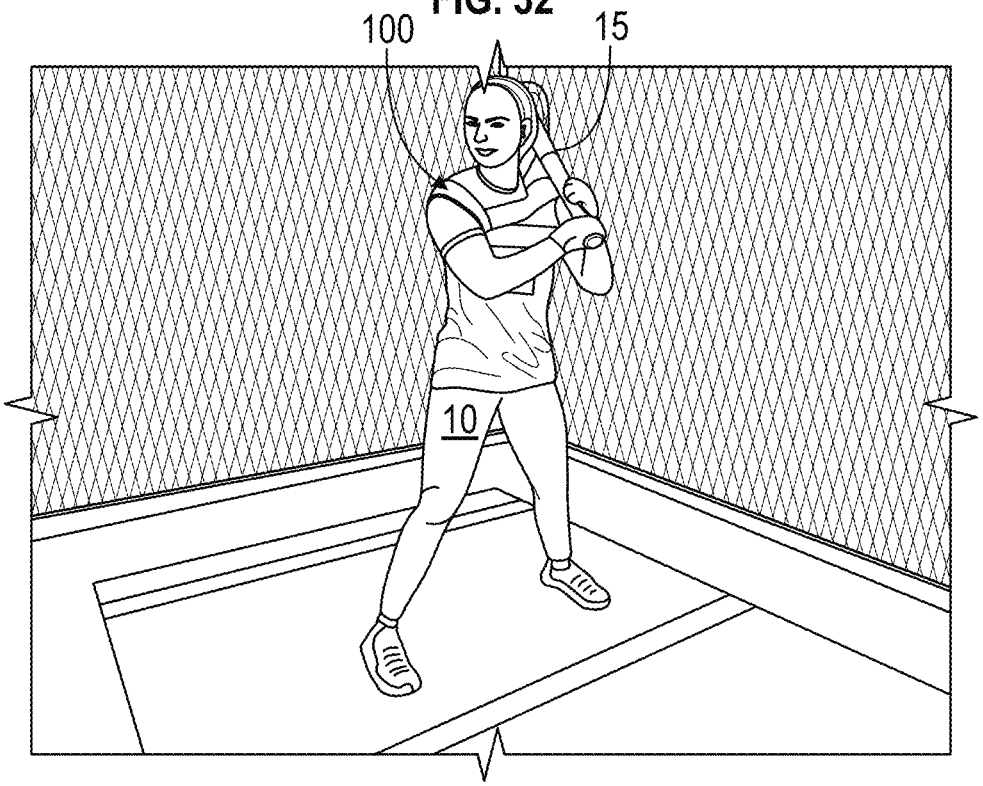

FIG. 29 is a photograph of a swinging device attachment 600 for use with a swinging device 15 and the shoulder harness system 100 described herein according to various embodiments of the present disclosure. The swinging device attachment 600 can include straps 605, 610 that are configured to be positioned around and secure laterally extending sides of the swinging device attachment 600 to the swinging device 15. The straps 605, 610 may include hook-and-loop fastener straps or other suitable connecting straps. The swinging device attachment 600 may be wrapped around a bat, a club, or other swinging device 15 to train an operator 10 to hit using certain spots of the bat, club, or other swinging device 15. Further, the swinging device attachment 600 may slide over an outer edge of a swinging device 15, like a sock, while including openings that are designed to get an operator 10 or other player to hit a certain spot of the bat, club, or other swinging device 15.

The material of the swinging device attachment 100 (e.g., also referred to as a "sweet spot trainer") can include plastic fibers, Velcro® material, leather, cloth, a combination thereof, or other suitable material that can slide over the club, bat, or other swinging device 15. For instance, the swinging device attachment 100 can act as a sock or other cover having one or more holes cut therein that define a "sweet spot," or an ideal spot for the swinging device 15 to make contact with a ball or other object to be contacted.

The components described herein can be implemented together or in various combinations as a single swing training device or a single swing training system. In various embodiments, the shoulder harness system 100 as well as the components described herein for use with the shoulder harness system 100 can be used in augmented reality environments, virtual reality environments, etc., for instance, in conjunction with augmented reality systems, virtual reality systems, etc. To this end, in various embodiments, one or more sensors (e.g., fiducial markers or location approximately sensors) may be positioned on a vest or other portion of the shoulder harness system 100 for virtual reality purposes, such as a remote control, for gaming and training with appropriate sensors in a virtual situation.

It is understood that disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Although embodiments have been described herein in detail, the descriptions are by way of example. The features of the embodiments described herein are representative and, in alternative embodiments, certain features and elements can be added or omitted. Additionally, modifications to aspects of the embodiments described herein can be made by those skilled in the art without departing from the spirit and scope of the present invention defined in the following claims, the scope of which are to be accorded the broadest interpretation so as to encompass modifications and equivalent structures.

Therefore, the following is claimed:

1. A swing training system, comprising:

a shoulder harness system comprising a wrist attachment and at least one coupling member having a first end configured to couple to the wrist attachment and a second end configured to couple to one of a shoulder portion of a chest portion of the shoulder harness system, wherein the shoulder harness system is configured to maintain a chest-to-arm position of an operator and detach from one of the shoulder portion or the chest portion of the shoulder harness system in response to a predefined amount of force being exerted by the operator during a swing motion using a swinging device; and at least one of:

a light system comprising a first light emitting device configured to couple to the wrist attachment and a second light emitting device configured to couple to a bottom end of the swinging device; and a stride training system comprising a foot harness configured to secure a foot magnet to a bottom of a foot of the operator and a target magnet plate, wherein the foot magnet and the target magnet plate are configured to form a magnetic coupling and emit an audible noise when the foot magnet comes into physical contact with the target magnet plate.

2. The swing training system of claim 1, further comprising a ball configured to connected to a vest or a shirt of the operator to rest the swinging device next to a desired position on a body of the operator and maintain a degree of separation between the operator and the swinging device.

3. The swing training system of claim 1, wherein:

the swinging training system includes the light system;

the first light emitting device is coupled to the wrist attachment, the first light emitting device being sized and positioned to shine light across a chest of the operator during the swing motion; and the second light emitting device is coupled to a bottom end of the swinging device, the second light emitting device being sized and positioned to shine light at a ground surface during the swing motion.

4. The swing training system of claim 3, wherein:

the first light emitting device is configured to emit light of a first color; and the second light emitting device is configured to emit light of a second color, the second color being a different color than the first color.

5. The swing training system of claim 3, wherein:

the first light emitting device comprises a first light emitting element, a first switch, and a first battery; and the second light emitting device comprises a second light emitting element, a second switch, and a second battery.

6. The swing training system of claim 1, wherein the at least one coupling member comprises a double-sided strip hook-and-loop fastening strip.

7. The swing training system of claim 1, wherein the at least one coupling member comprises a rigid member formed of metal.

8. The swing training system of claim 1, wherein:

the wrist attachment is a first wrist attachment to be worn on a first wrist of the operator;

the swing training system further comprises a second wrist attachment to be worn on the second wrist of the operator;

the at least one coupling member is a first coupling member and a second coupling member;

a first end of the first coupling member is configured to be secured to the first wrist attachment, and a second end of the first coupling member is configured to removably attach to the shoulder portion; and a first end of the second coupling member is configured to be secured to the second wrist attachment, and a second end of the second coupling member is configured to removably attach to the chest portion.

9. The swing training system of claim 8, wherein the second end of the first coupling member comprises a first magnet configured to magnetically couple to the shoulder portion; and the second end of the second coupling member comprises a second magnet configured to magnetically couple to the chest portion.

10. The swing training system of claim 1, wherein the swing training system further comprises a collar configured to detechably attach to a shaft of a swinging device, the collar comprising a first portion detachably attached to a second portion, the collar further comprising an elongated substantially horizontal surface projecting from at least one of the first portion and the second portion, the elongated substantially horizontal surface being adapted to contact a ball.

11. The swing training system of claim 1, wherein the swing training system further comprises a stride box comprising a plurality of members oriented relative to each other that define a space in which a stride of a swing takes place using the stride training system.

12. A method, comprising:

providing the swing training system of claim 1;

positioning the shoulder harness system on the operator; and performing, by the operator, a swing using the shoulder harness system and at least one of the light system or the stride training system.

* * * * *